US008806884B2

(12) United States Patent
Park et al.

(10) Patent No.: US 8,806,884 B2
(45) Date of Patent: Aug. 19, 2014

(54) REFRIGERATOR

(75) Inventors: Sang-Ho Park, Gyeongsangnam-do (KR); Dong-Jin Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 272 days.

(21) Appl. No.: 13/264,191

(22) PCT Filed: Aug. 31, 2009

(86) PCT No.: PCT/KR2009/004890

§ 371 (c)(1), (2), (4) Date: Oct. 13, 2011

(87) PCT Pub. No.: WO2010/123175

PCT Pub. Date: Oct. 28, 2010

(65) Prior Publication Data

US 2012/0036882 A1 Feb. 16, 2012

(30) Foreign Application Priority Data

Apr. 23, 2009 (KR) ..... 10-2009-0035350

(51) Int. Cl.
*F25D 11/02* (2006.01)

(52) U.S. Cl.
USPC ..... 62/344; 62/389

(58) Field of Classification Search
CPC ... F25D 11/02; F25D 23/126; F25D 2400/06; F25D 23/023; F25C 2400/10
USPC ..... 62/344, 389, 340, 449
See application file for complete search history.

(56) References Cited

U.S. PATENT DOCUMENTS

| | | | | | |
|---|---|---|---|---|---|
| 3,982,406 | A | * | 9/1976 | Hanson et al. | 62/339 |
| 4,274,390 | A | * | 6/1981 | Azuma | 126/19.5 |
| 5,112,477 | A | * | 5/1992 | Hamlin | 210/85 |
| 5,299,529 | A | * | 4/1994 | Ramirez | 119/51.11 |
| 5,673,817 | A | * | 10/1997 | Mullen et al. | 222/94 |
| 5,697,519 | A | * | 12/1997 | Wittern et al. | 221/76 |
| 5,884,361 | A | * | 3/1999 | Richardson et al. | 16/100 |
| 8,336,330 | B2 | * | 12/2012 | Lee et al. | 62/442 |
| 2006/0162369 | A1 | | 7/2006 | Chae | |
| 2009/0090123 | A1 | | 4/2009 | Son et al. | |

FOREIGN PATENT DOCUMENTS

| | | | | |
|---|---|---|---|---|
| CN | 1811308 | A | | 8/2006 |
| CN | 101071026 | A | | 11/2007 |
| JP | 2002-188875 | | * | 7/2002 |
| KR | 10-1998-066100 | A | | 10/1998 |
| KR | 10-2006-085985 | A | | 7/2006 |
| KR | 10-2009-013573 | A | | 2/2009 |
| KR | 10-2009-036188 | A | | 4/2009 |

OTHER PUBLICATIONS

Abstract of JP 2002-188875 to Kawasumi, Masaaki.*
Translation of JP 2002-188875 to Kawasumi, Masaaki.*
International Search Report dated May 14, 2011 for Application No. PCT/KR2009/004890, 2 pages.
Chinese Office Action dated Mar. 25, 2013 for Application No. 200980158861.x with English Translation, 14 pages.

* cited by examiner

*Primary Examiner* — Mohammad M Ali
(74) *Attorney, Agent, or Firm* — Fish & Richardson P.C.

(57) ABSTRACT

A refrigerator is provided. Usability and efficiency of a storage space are improved in the refrigerator.

15 Claims, 35 Drawing Sheets

Fig. 5
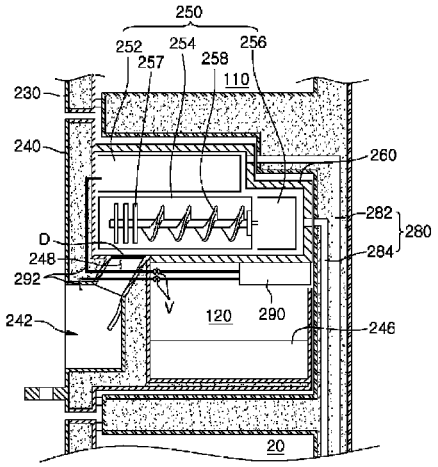
[Fig. 6]
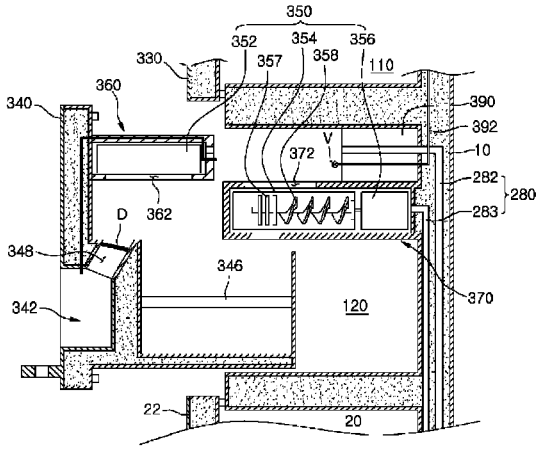

REFRIGERATOR

TECHNICAL FIELD

The present disclosure relates to a refrigerator.

BACKGROUND ART

Generally, refrigerators are home appliances for storing foods at low temperature in an internal storage space covered by a refrigerator door. The refrigerators can store foods at an optimum state by cooling the storage space using cooling air generated through heat exchange with a refrigerant circulating a cooling cycle.

Refrigerators generally include internal storage spaces divided into a refrigerator compartment and a freezer compartment. The temperature within the refrigerator compartment is maintained at about 1 to 4 degrees centigrade to store foods such as vegetables in a fresh state. The temperature within the freezer compartment is maintained at about 18 degrees below zero centigrade to store foods such as meats and fishes in a frozen state. Various types of refrigerators may be provided according to an arrangement of the refrigerator compartment and the freezer compartment and configurations of refrigerator doors that cover the refrigerator compartment and the freezer compartment.

The size of the refrigerators tends to increase more and more and multi-functions are provided to the refrigerators as dietary life changes and pursues high quality, and accordingly, refrigerators of various structures with consideration of user convenience are brought to the market.

Such a refrigerator is classified into a side by side-type refrigerator in which a freezer compartment and a refrigerator compartment are horizontally arranged side-by-side, a bottom-freezer type refrigerator in which a freezer compartment is disposed below a refrigerator compartment, and a top mount-type refrigerator in which a freezer compartment is disposed above a refrigerator compartment. Thus, a refrigerator of the desired type can be selected according to user's requirements.

An ice maker for making and storing ice is provided in the refrigerator. The ice maker is disposed inside a body of the refrigerator, or is disposed in a refrigerator door for covering a portion of the body. At this time, the refrigerator door including the ice maker usually includes a pivotable door.

A dispenser for dispensing the ice made by the ice maker to the outside is disposed in the refrigerator door. Thus, a desired amount of ice can be dispensed according to a user s manipulation without opening the refrigerator door.

DISCLOSURE OF INVENTION

Technical Problem

Embodiments provide a refrigerator in which a space where received foods and objects are classified into each type and are stored is provided, an ice making assembly is disposed within the space, and a dispenser is disposed in a door for opening and closing the space.

Embodiments also provide a refrigerator in which a transparent refrigerator compartment door is provided to confirm an inner receipt state of a refrigerator compartment, as well as, a separate space capable of storing objects and foods received in the refrigerator compartment door is provided. Moreover, since the foods and the objects are not received in the refrigerator compartment door, the refrigerator compartment door may be easily opened and closed.

Embodiments also provide a refrigerator in which one refrigerator compartment may be covered by a transparent refrigerator compartment door, that is pivotally opened and closed, and a slidable door that is withdrawn in a drawer-type.

Embodiments also provide a refrigerator in which a transparent refrigerator compartment door may be provided to confirm foods received in a slidable door.

Technical Solution

In one embodiment, a refrigerator includes: a refrigerator compartment; a freezer compartment; a plurality of refrigerator compartment doors opening and closing the refrigerator compartment, the refrigerator compartment doors including a pivotable door and a slidable door; a freezer compartment door opening and closing the freezer compartment; and a dispenser disposed on the slidable door to dispense water and/or ice.

In another embodiment, a refrigerator includes: a refrigerator compartment; a wall partitioning the refrigerator compartment into a left side space and a right side space; a freezer compartment disposed below the refrigerator compartment; a pivotable door opening and closing the left side space; a slidable door opening and closing the right side space; a freezer compartment door opening and closing the freezer compartment; and a dispenser disposed in the slidable door to dispense water and/or ice.

In further another embodiment, a refrigerator includes: a refrigerator compartment; a freezer compartment; a plurality of refrigerator compartment doors opening and closing the refrigerator compartment, the refrigerator compartment doors including a pivotable door and a plurality of slidable doors; a freezer compartment door opening and closing the freezer compartment; and a dispenser disposed on one of the plurality of slidable doors to dispense water and/or ice.

In still further another embodiment, a refrigerator includes: a refrigerator compartment; a freezer compartment; a plurality of refrigerator compartment doors opening and closing the refrigerator compartment, the refrigerator compartment doors including a pivotable door and a slidable door; a freezer compartment door opening and closing the freezer compartment; and a dispenser disposed at a rear side of the slidable door, the dispenser being exposed by opening the slidable door.

In still further another embodiment, a refrigerator includes: a refrigerator compartment; a freezer compartment; a plurality of refrigerator compartment doors opening and closing the refrigerator compartment, the refrigerator compartment doors including a pivotable door and a slidable door; a freezer compartment door opening and closing the freezer compartment; an ice making compartment disposed on a back surface of slidable door; and a receiving part extending from a back surface of the ice making compartment toward a rear direction.

In still further another embodiment, a refrigerator includes: a refrigerator compartment; a freezer compartment; a plurality of refrigerator compartment doors opening and closing the refrigerator compartment, the refrigerator compartment doors including a pivotable door and a slidable door; a freezer compartment door opening and closing the freezer compartment; an ice making compartment fixed inside the refrigerator compartment; and a dispenser disposed on the slidable door.

In still further another embodiment, a refrigerator includes: a refrigerator compartment; a freezer compartment; a plurality of refrigerator compartment doors opening and closing the refrigerator compartment, the refrigerator compartment doors including a pivotable door and a slidable door; a freezer compartment door opening and closing the freezer compartment; and an ice making assembly including at least ice maker and ice bank, wherein the ice maker is fixed to the refrigerator compartment, and the ice bank is fixed to the slidable door.

In still further another embodiment, a refrigerator includes: a refrigerator compartment; a freezer compartment; a plurality of refrigerator compartment doors opening and closing the refrigerator compartment, the refrigerator compartment doors including a pivotable door and a slidable door; a freezer compartment door opening and closing the freezer compartment; and an ice making assembly including at least ice maker and ice bank, wherein the ice maker is fixed to the refrigerator compartment, and the ice bank is fixed to the slidable door.

The details of one or more embodiments are set forth in the accompanying drawings and the description below. Other features will be apparent from the description and drawings, and from the claims.

Advantageous Effects

According to the refrigerator of the present embodiments, the storage room covered by the drawer-type door is provided at a side of the body, and the ice maker for making the ice is disposed on the back surface of the door for opening and closing the storage room. Thus, when the door is withdrawn, the ice maker is withdrawn together with the door.

Therefore, the space within the refrigerator compartment or the freezer compartment can be efficiently utilized, and an overall configuration of the refrigerator can be newly designed to improve the space utilization of the refrigerator.

The dispenser can be disposed in the front surface of the door to dispense the ice made from the ice maker at the outside, thereby to easily dispense the ice.

The receiving part is disposed at the upper or lower portion of the ice making compartment disposed on the drawer-type door including the ice maker. As a result, the ice can be made in the storage room, as well as, the foods can be stored in the storage room in a refrigerated or frozen state. Therefore, the space efficiency of the refrigerator can be maximized.

According to the refrigerator of the present embodiments, the refrigerator may be opened and closed by the refrigerator compartment door in which the receiving part is pivotably disposed inside the storage room, the first door, and second door, which are withdrawn in the drawer-type.

Thus, the receiving part within the refrigerator compartment can have the shelf shape and the pantry shape at the same time to improve the overall space efficiency of the refrigerator.

The refrigerator according to the present embodiments can include the transparent refrigerator compartment door. Therefore, the foods received into the first door and the second door can be viewed through the refrigerator compartment door.

Thus, the user can quickly confirm positions of the desired foods without opening the door to improve the user s convenience.

Also, since the door need not be unnecessarily opened for confirming the foods, power consumption can be reduced, as well as refrigerating efficiency can be improved.

Also, since the back surface of the refrigerator compartment door has a structure in which the foods are not received, the shelf can extend up to the front end of the refrigerator compartment, thereby to improve receipt of the refrigerator. In addition, since the foods are not received in the refrigerator compartment door, the refrigerator compartment door can be light. Therefore, the operation for opening and closing the door can be further easy.

BRIEF DESCRIPTION OF DRAWINGS

FIG. 5 is a partial cross-sectional view of a refrigerator according to another embodiment.

FIG. 6 is a partial cross-sectional view of a refrigerator according to another embodiment.

MODE FOR THE INVENTION

Reference will now be made in detail to the embodiments of the present disclosure, examples of which are illustrated in the accompanying drawings. However, the spirit and scope of the principles of the present disclosure are limited to the embodiments explained with reference to the accompanying drawings. Other embodiments can be devised within the spirit and scope of the principles of this disclosure, for example, by modifying, adding or deleting the embodiments explained with reference to the accompanying drawings.

Figure 1:
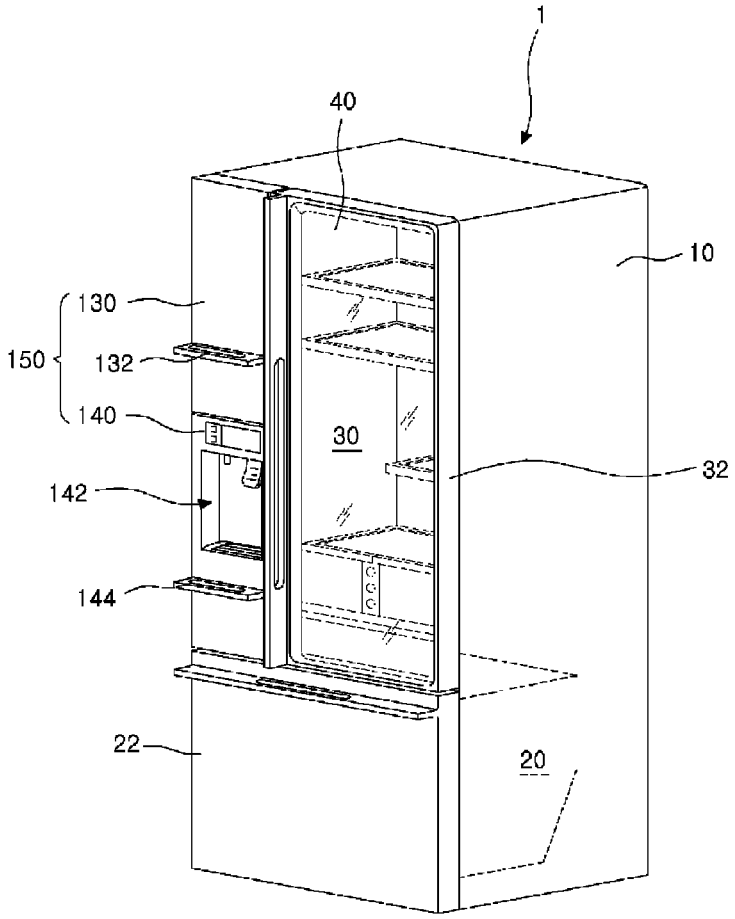
FIG. 1 is a perspective view of a refrigerator according to an embodiment.
Figure 2:
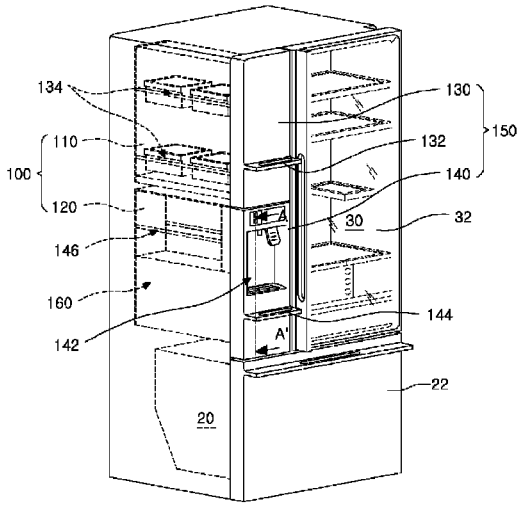
FIG. 2 is an opened-up view of a refrigerator according to an embodiment.

FIG. 1 is a perspective view of a refrigerator according to an embodiment, and FIG. 2 is an opened-up view of a refrigerator according to an embodiment.

Referring to FIGS. 1 and 2, a refrigerator 1 according to present embodiment has an approximately rectangular parallelepiped shape. An outer appearance of the refrigerator 1 is defined by a body 10 defining a storage space and a plurality of door provided in the body 10.

The body 10 has an opened front surface. The body 100 is vertically partitioned into a freezer compartment 20 below and a refrigerator compartment 30 and a storage room 100 above. Each of the partitioned spaces may have an independent storage space.

In detail, the freezer compartment 20 is defined at a lower side of the body 10 and may be selectively covered by a drawer-type freezer compartment door 22. A space defined above the freezer compartment 20 is partitioned into left and right sides to respectively define the storage room 100 and the refrigerator compartment 30.

The refrigerator compartment 30 is defined at the right side (when viewed in FIG. 1) above the freezer compartment 20. A plurality of drawers and shelves is provided inside the refrigerator compartment 30 to store foods. The refrigerator compartment 30 may be selectively opened or closed by a refrigerator compartment door 32 pivotably installed on the body 10.

The refrigerator compartment door 32 has a size corresponding to that of the opened front surface of the refrigerator compartment 30. At least portion of the refrigerator compartment door 32 is transparent to enable the refrigerator compartment 30 to be viewed through the refrigerator compartment door 32.

The storage room 100 is defined at the left side (when viewed in FIG. 1) of the refrigerator compartment 30. The storage room 100 is separated from the refrigerator compartment 30 by a barrier 40. Also, the storage room 100 may be selectively covered by a drawer-type door 150.

Hereinafter, the refrigerator compartment door pivotably installed to open and close the refrigerator compartment 30 is referred to as a pivotable door. One or more drawer-type doors for opening and closing the storage room 100 are referred to one or more slidable doors.

When the storage room 100 provided at a side of the refrigerator compartment 30 is used as a refrigerator compartment, the refrigerator compartment door may include the pivotable door as well as the slidable door. Also, when the storage room 100 is used as the refrigerator compartment, the freezer compartment door 22 may include the pivotable door and the slidable door. When the storage room 100 is used as a switching room, the storage room 100 may be denoted as a separate switching room door.

In embodiments disclosed below, when the refrigerator compartment 30 and the storage room 30 are defined in one space, it is obvious to those skilled in the art that the refrigerator compartment door includes the pivotable door and the slidable door.

To avoid confusion in term construction, the refrigerator compartment door used in the detailed description of the present disclosure denotes the pivotable door. However, it is noted that a refrigerator compartment door noted in claims includes the pivotable door as well as the slidable door for opening and closing the storage room used as the refrigerator compartment.

The storage room 100 is partitioned into an upper portion and a lower portion by a partition. That is, the storage room 100 may be divided into a first storage room 100 above and a second storage room 120 below. A first door 130 and a second door 140 are withdrawably provided at the first storage room 110 and the second storage room 120, respectively. If necessary, one storage room 100 may be provided, or two or more storage rooms 100 may be provided.

The first door 130 is withdrawably installed in the storage room 100. The first door 130 may be completely inserted to completely cover the first storage room 110. A receiving part 134 extending backwardly is disposed in a back surface of the first door 130.

The receiving part 134 may have a shape similar to that of a pantry shelf. The receiving part 134 may extend up to a length corresponding to that from the back surface of the first door 130 to an inner rear surface of the first storage room 110. The receiving part 134 may be vertically provided in two stages. Also, the receiving part 134 may be vertically provided in two or multi-stages according to kinds or shapes of received foods.

For example, as shown in FIG. 2, racks may be disposed on both sides of the receiving part 134 to seat an exclusive vessel. Also, the receiving part 134 may have a shape corresponding to that in which wine bottles and vessels are easily received. In addition, the receiving part 134 may have various structures such as a basket or shelf shape.

If necessary, the receiving part 134 may be provided in a single stage when the first storage room 110 is short in vertical length. Also, the receiving part 134 may be provided in two or more stages when the first storage room 100 is long in vertical length.

A second storage room 120 is defined below the first storage room 110. The second storage room 120 may be separated from the refrigerator compartment 30 and the freezer compartment 20, like the first storage room 110. The second storage room 120 is defined above the freezer compartment 20.

A second door 140 withdrawable in front and rear directions is provided on the second storage room 120. The second storage room 120 may be selectively covered by withdrawal of the second door 140.

An ice making compartment 160 may be defined in a back surface of the second door 140. The ice making compartment 160 is a space in which ice is made, and the made ice is stored. An ice maker 162 for making at least ice is disposed inside the ice making compartment 160. The ice maker 162 receives water to make the ice. A water supply process and an ice conveying process may be automatically performed in the ice maker.

When the second storage room 120 is maintained at a temperature corresponding to that of the refrigerator compartment, the interior of the ice making compartment 160 may be thermally insulated from the second storage room 120. That is, the second storage room 120 may be thermally isolated from the ice making compartment 160 by a separate insulation structure. On the other hand, when the second storage room 120 is maintained at a temperature corresponding to that of the freezer compartment, transfer devices as well as the ice maker 162 may be received within the second storage room 120 without requiring a separate insulation or isolation structure.

The ice making compartment 160 may be integrally formed with the back surface of the second door 140, and thus, may be integrally withdrawn together with the second door 140.

At least portion of the ice making compartment may be selectively opened and closed to allow the ice maker 162 within the ice making compartment to be easily repaired and managed.

The ice making compartment 160 may be defined in a relatively lower region of the second door 140. A receiving part 146 for receiving foods may be disposed at a rear side of the second door 140 corresponding to an upper region of the ice making compartment 160. The receiving part 146 may have various structures, like the previously described receiving part 134 of the first door 130. The received foods may be withdrawable together according to the withdrawal of the second door 140. The stored in the receiving part 146 may be divided into refrigerating foods and freezing foods according to an internal temperature of the first storage room 110. A dispenser 142 for dispensing ice and/or water may be disposed in a front surface of the second door 140.

Figure 3:
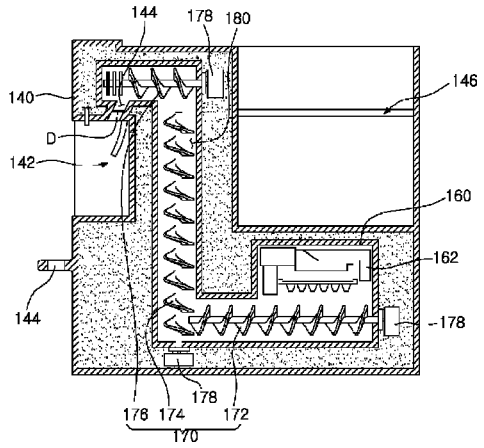
FIG. 3 is a cross-sectional view illustrating a drawer type door of a refrigerator according to an embodiment.

FIG. 3 is a cross-sectional view illustrating a drawer type door of a refrigerator according to an embodiment. Also, FIG. 3 is a cross-sectional view taken along line A-A of FIG. 2.

A configuration of the second door 140 will be described in detail with reference to FIG. 3. The ice making compartment 160 protrudes backwardly from a rear surface of the second door 140. The ice making compartment 160 is disposed in a lower portion of the second door 140, and the receiving part 146 is disposed above the ice making compartment 160.

The ice maker 162 for making ice using the supplied water and the transfer device 170 for transferring the made ice toward the dispenser 142 are disposed inside the ice making compartment 160.

The ice maker 162 is disposed in a rear portion of the ice making compartment. A water supply passage and cool air duct may be separably connected to the ice maker 162 so as to supply water and cool air when the second door 140 is completely inserted.

If necessary, a separate water tank for storing ice making water may be disposed in the ice making compartment. The water tank may be directly filled with the ice making water by a user to supply the water to the ice maker 162.

The transfer device 170 for supplying the ice conveyed from the ice maker 162 to the dispenser 142 may be disposed inside the ice making compartment 160. The transfer device 170 supplies the water to a dispensing hole 144 defined at a position higher than that of the ice maker 162. That is, when the dispensing hole 144 defined in the dispenser 142 is located at a position higher than that of the ice maker 162, the transfer device 170 may be provided as shown in FIG. 1. The transfer device 170 may include a first transfer device 172, a second transfer device 174, and a third transfer device 176.

In detail, the first transfer device 172 may be disposed in a lower portion of the ice maker 162, may be parallel to the ice maker 162, and may be operated by a motor 178. The first transfer device 172 may have a spiral or coil shape to guide the ice conveyed from the ice maker 162 to a front side of the ice making compartment, i.e., toward the second door 140.

The second transfer device 174 may be disposed at a front end portion. The second transfer device 174 may be vertically disposed parallel to the second door 140. Also, the second transfer device 174 may be rotated by the separate motor 178, like the first transfer device 172. On the other hand, a front end of the first transfer device 172 may be connected to a front end of the second transfer device 174 using a medium such as a bevel gear and may be operated by a single motor.

The second transfer device 174 may have a spiral or coil shape to transfer the ice transferred by the first transfer device 172 to an upward direction. At this time, an upper end of the second transfer device 174 may be located at a position higher than that of the dispensing hole 144 of the dispenser 142.

The third transfer device 176 may be disposed at the upper end of the second transfer device 174. The third transfer device 176 is horizontally disposed and has a spiral or coil shape. The third transfer device 176 is rotated by the separate motor 178 to transfer the ice transferred upwardly by the second transfer device 174 to a front direction, i.e., toward the dispensing hole 144. The second transfer device 174 may be connected to the third transfer device 176 using a medium to rotate by a single drive unit. A damper D may be disposed in the dispensing hole 144 to selectively cover the dispensing hole 144. That is, the ice may be selectively dispensed by an operation of the damper D.

If necessary, the transfer device 170 may have a shape different from the spiral or coil shape. A transfer passage 180 having a diameter somewhat greater than that of the transfer device 170 may be defined inside the ice making compartment 160 to smoothly transfer the made ice along the transfer device 170.

The first storage room 110 and the second storage room 120 may be used as a refrigerator compartment or a freezer compartment. The first storage room 110 and the second storage room 120 may be used as the switching room that can be converted into the refrigerator compartment or the freezer compartment by varying a temperature as necessary. At this time, the ice making compartment 160 should be formed as a completely independent insulation space within the second storage room 120.

Although not shown, an evaporator for generating cool air is disposed at a rear side of the freezer compartment 20. The cool air generated by the evaporator is supplied into the freezer compartment 20, the refrigerator compartment 30, the storage room 100, and the ice making compartment 160 to cool the spaces, respectively.

Specifically, when the second door 140 is closed, the cool air duct for supplying the cool air may communicate with the ice making compartment 160 to perform an ice making operation in the ice maker 162 received within the ice making compartment 160.

Hereinafter, an operation of the refrigerator including the above-described components will be described in detail with reference to accompanying drawings.

To receive the foods into the refrigerator 1, the door is opened to store the foods in the refrigerator 1, and then, the door is closed again.

Specifically, in case of the first storage room 110, the user grasps a door handle 132 of the first door 130 to slidingly withdraw the first door 130, thereby to open the first storage room 110. Then, the foods may be received into the receiving part 134 disposed at a rear side of the first door 130. After the foods are received, the first door 130 is inserted to close the first storage room 110.

Similarly, in case of the second storage room 120, the user draws a door handle 144 of the second door 140 to slidingly withdraw the second door 140, thereby to open the second storage room 120. When the second door 140 is withdrawn, the ice making compartment 160 integrally formed with the second door 140 is withdrawn together and is exposed to the outside. Also, the receiving part 146 disposed above the ice making compartment 160 is withdrawn together with the second door 140 and is exposed to the outside.

In case where the dispenser 142 is not provided in the second door 140, when the storage room 100 is opened, at least side of the ice making compartment 160 may be opened to take the ice out of the ice making compartment 160 in a state where the second door 140 is opened.

The water and cool air may be supplied into the second door 140 in a state where the second door 140 is completely inserted into the second storage room 120. Thus, after the second door 140 is completely closed, the ice is made by the ice maker 162, and then, the made ice is dropped downwardly.

The ice stored below the ice maker 162 is horizontally moved by the first transfer device 172, and then, is vertically moved by the second transfer device 174. Then, the ice is horizontally moved by the third transfer device 176 to reach the dispensing hole 144 of the dispenser 142. Finally, the ice transferred into the dispensing hole 144 is dispensed to the outside through a manipulation of the dispenser 142.

For a service of the ice maker 162 or the transfer device 170, the second door 140 is withdrawn to expose the ice making compartment 160 to the outside. In this state, the ice maker 162 or the transfer device 170 may be repaired, for this, the ice maker 162 and the transfer device 170 may be detachably provided.

For receiving the foods into the receiving part 146 of the second door 140, the second door 140 is withdrawn to expose the receiving part 146 to the outside, and then, the foods are received into the receiving part 146. At this time, the foods stored in the receiving part 146 are stored in a refrigerated or frozen state according to an internal temperature of the second storage room 120.

The refrigerator may be also applied to various embodiments except for the previously described embodiment. Hereinafter, a refrigerator according to another embodiment will be described. Components having the same structure as those of the previously described embodiment will be given by the same reference numerals, and thus, detailed descriptions thereof will be omitted.

Figure 4:
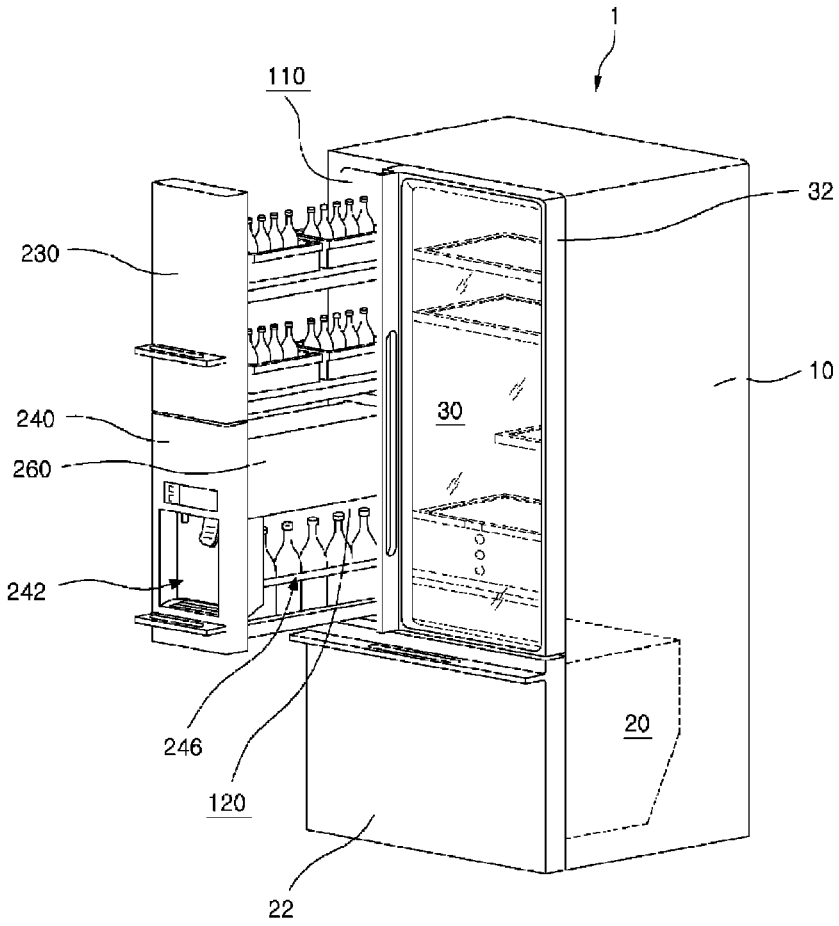
FIG. 4 is an opened-up view of a refrigerator according to another embodiment.

FIG. 4 is an opened-up view of a refrigerator according to another embodiment, and FIG. 5 is a partial cross-sectional view of a refrigerator according to another embodiment.

In the present embodiment, an ice making compartment is integrally formed with a back surface of a door for opening and closing a storage room.

Referring to FIGS. 4 and 5, a refrigerator 1 according to another embodiment includes a body 10, in which a refrigerator compartment 30, a freezer compartment 20, a first storage room 110, and a second storage room 120 are defined, a refrigerator compartment door 32, a freezer compartment door 22, a first door 230, and a second door 240. The refrigerator compartment door 32, the freezer compartment door 22, the first door 230, and the second door 240 selectively cover the refrigerator compartment 30, the freezer compartment 20, the first storage room 110, and the second storage room 120, respectively. An outer appearance of the refrigerator 1 is defined by the body 10 and the doors 32, 22, 230, and 240.

The second storage room 120 is defined below the first storage room 110. The second storage room 120 is selectively covered by the second door 240. The second door 240 is slidingly withdrawably disposed inside the second storage room 120. An ice making compartment 260 in which an ice making assembly 250 is received is defined in a back surface of the second door 240.

The ice making compartment 260 extends backwardly from an upper portion of the second door 240 toward a rear direction. A receiving part 246 for receiving foods is disposed below the ice making compartment. The receiving part 246 extends backwardly up to a length equal to that of the ice making compartment 260, and may have various shapes according to kinds of foods.

A dispenser 242 for dispensing ice supplied from the ice making assembly 250 to the outside may be disposed in a front surface of the second door 240. The dispenser 242 may be disposed at a position lower than that of the ice making compartment 260 to easily dispense the ice. The dispenser 242 may be located at a position relatively near to an upper end of the second door 240 to dispense the ice or water without bending waist.

In detail, in case where the second storage room 120 is maintained at a temperature corresponding to that of the freezer compartment 20, the ice making assembly 250 may be installed without being isolated by an insulation member. On the other hand, in case where the second storage room 120 is maintained at a temperature corresponding to that of the second storage room 120, the ice making compartment may be formed in an independent isolated space by a separate insulation wall structure within the second storage compartment 120.

An ice chute 248 communicating the ice making compartment 260 with the dispenser 242 is disposed in a rear surface of the second door 240 in which the dispenser 242 is disposed. The ice stored inside the ice making compartment 260 may be supplied into the dispenser 242 through the ice chute 248. The ice chute 248 may be opened and closed by a user s manipulation. A damper D may be disposed in the ice chute 248 to selectively dispense the ice. The damper D may be also provided in another embodiments disclosed below, and thus, it should be construed that a damper structure is applicable even if the damper D is not explained.

The ice making assembly 250 disposed inside the ice making compartment 260 includes an ice maker 252 for making ice and an ice bank 254 disposed below the ice maker 252 to store the made ice. An auger 258 operated by an electric motor is disposed in the ice bank 254 to transfer the ice stored in the ice bank 254 toward the ice chute 248. In detail, the ice making assembly 250 includes the ice maker 252, the ice bank 254, the auger 258, a crusher 257 disposed at a position spaced apart from the auger 258 to crush the ice, and the electric motor 256 for rotating the auger 258 and the crusher 257.

In case where the second storage room 120 is maintained at a temperature corresponding to that of the refrigerator compartment, a cool air inlet 262 and a cool air outlet 264 are separately formed. The cool air inlet 262 and the cool air outlet 264 may communicate with a cool air duct 280 disposed inside the second storage room 120 in a state where the second door 240 is completely inserted.

The cool air duct 280 includes a supply duct 282 selectively communicating with the cool air inlet 262 to supply cool air generated by an evaporator into the ice making compartment 250 and a return duct 284 selectively communicating with the cool air outlet 264 to guide the cool air within the ice making compartment 260 toward the evaporator. A water tank 290 for storing water to be supplied into the ice maker 252 and drinking water to be supplied into the dispenser 242 may be disposed inside the second storage room 120. The water tank 290 may be selectively connected to the ice maker 252 and the dispenser 242 by a water supply passage 292.

The water tank 290 may be disposed inside the ice making compartment 260. The water tank 290 may be directly connected to a water supply source or may be directly filled by a user. When the second door 240 is withdrawn forwardly, the water supply passage 292 may be separated at any position, and an opening/closing valve V may be disposed at the separated position. That is, when the second door 240 is opened, the opening/closing valve V is closed to prevent water from being supplied into the dispenser 242. When the second door 240 is completely closed, the opening/closing valve V is opened to supply the water into the dispenser 242. A kind of opening/closing valve V is not limited. The same opening/closing valve V may be applicable to drawings indicated below, duplicated descriptions will be omitted.

The refrigerator may be also applied to various embodiments except for the previously described embodiment. Hereinafter, a refrigerator according to further another embodiment will be described. Components having the same structure as those of the previously described embodiment will be given by the same reference numerals, and thus, detailed descriptions thereof will be omitted.

In the present embodiment, an ice maker is integrally formed with a back surface of a door for opening and closing a storage room.

FIG. 6 is a partial cross-sectional view of a refrigerator according to another embodiment.

Referring to FIG. 6, a first storage room 110 and a second storage room 120 are defined in a refrigerator body 10. The second storage room 120 may be selectively covered by slidingly withdrawing the second door 340.

A dispenser 340 for dispensing made ice at the outside is disposed in a front surface of the second door 340. An ice maker 352 for making the ice is disposed on a back surface of the second door 340.

The ice maker 352 is received into an ice making compartment upper part 360 defined in the second door 340. The ice making compartment upper part 360 is selectively connected to an ice making compartment lower part 370, which will be described later, to form an insulation space. The ice making compartment upper part 360 protrudes backwardly from an upper portion of a back surface of the second door 340 to receive the ice maker 352.

An opening 362 is defined in a bottom surface of the ice making compartment upper part 360 to downwardly move ice made by the ice maker 352. A cool air inlet 364 communicating with a supply duct 282 disposed in the body 10 is defined in a rear surface of ice making compartment upper part 360.

An ice bank 354 is disposed direct below the ice maker 352 in a state where the second door 340 is completely inserted. The ice maker 354 is received into the ice making compartment lower part 370 defined inside the second storage room 120. An auger 358 is operated by an electric motor 356 to guide the ice stored in the ice bank 354 toward an ice chute 348. When a crusher 357 is operated according to a user s selection, the ice is crushed at an inlet of the ice chute 348 and is dispensed through the dispenser 342. A region including the ice making compartment upper part 360 and the ice making compartment lower part 370 is defined as an ice making compartment. The ice making compartment constitutes a portion of the second storage room 120. It may be construed that the ice making compartment upper part 360 and the ice making compartment lower part 370 denote structures that are independently formed for partitioning the ice making compartment. That is, the ice maker 352 is received into the structure defining the ice making compartment upper part 360, the ice bank 354 is received into the structure defining the ice making compartment lower part 370. An ice making assembly 350 include the ice maker 352, the ice bank 354, the electric motor 356, the crusher 357, and the auger 358.

An opening 372 communicating with the opening 362 of the ice making compartment upper part 360 when the second door 340 is completely inserted is defined in a top surface of the ice making compartment lower part 370. The opening 372 communicates with a return duct 284 to circulate cool air into the ice making compartment upper part 360 and the ice making compartment lower part 370.

A water tank 390 is disposed at an upper side of the ice making compartment lower part 370. A water supply passage 392 for supplying ice making water and drinking water is selectively connected to the water tank 390 when the second door 340 is inserted. Thus, the ice making water and the drinking water may be supplied into the ice maker 352 and the dispenser 342, respectively, in a state where the second door 340 is closed.

In case where the second storage room 120 is maintained at a temperature corresponding to that of the refrigerator compartment, the ice making compartment upper part 360 and the ice making compartment lower part 370 form a closed insulation space, i.e., one ice making compartment. On the other hand, in case where the second storage room 120 is maintained at a temperature corresponding to that of the freezer compartment, the ice making compartment upper part 360 and the ice making compartment lower part 370 need not be insulated and closed. That is, it may be possible to install the ice maker 352 and the ice bank 354 in a state where the ice making compartment upper part 360 and the ice making compartment lower part 370 are not separately partitioned.

A receiving part 346 for receiving foods is disposed at a lower portion of a back surface of the second door 340. The receiving part 346 is withdrawn together with the ice making compartment upper part 360 when the second door 340 is withdrawn to easily receive the foods. The receiving part 346 may have various structures according to kinds of received foods.

Figure 7:
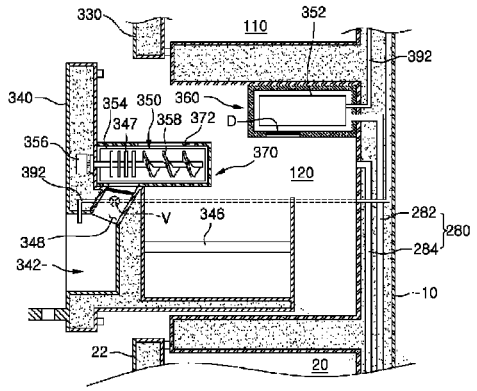
FIG. 7 is a vertical cross-sectional view of a refrigerator according to another embodiment.

FIG. 7 is a vertical cross-sectional view of a refrigerator according to another embodiment.

Referring to FIG. 7, components of the present embodiment have the same structure as those of FIG. 6, except that the ice making compartment upper part 360 receiving the ice maker 352 is fixed to an inner sidewall of the second storage room 120, and the ice making compartment lower part 370 receiving the ice bank 354 is fixed to the back surface of the second door 340. That is, when the second door 340 is withdrawn, the ice making compartment lower part 370 is also withdrawn together with the second door 340, and therefore, is separated from the ice making compartment upper part 360.

The water supply passage 392 directly connected to the water supply source supplies the water into the ice maker 352. However, it may be possible to install a separate water tank, like the embodiment of FIG. 6. An opening/closing valve V is disposed at any position of the water supply passage 392 extending toward the dispenser 342 to dispense the drinking water. The opening/closing valve V may be selectively closed according to an open or close state of the second door 340.

The refrigerator may be also applied to various embodiments except for the previously described embodiments. Hereinafter, a refrigerator according to further another embodiment will be described. Components having the same structure as those of the previously described embodiment will be given by the same reference numerals, and thus, detailed descriptions thereof will be omitted.

In the present embodiment, an ice making assembly and a dispenser are provided in a first door.

Figure 8:
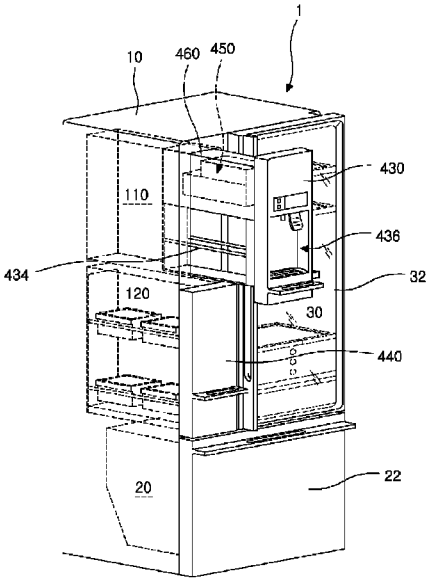
FIG. 8 is an opened-up view of a refrigerator according to another embodiment.

FIG. 8 is an opened-up view of a refrigerator according to another embodiment.

Referring to FIG. 8, a refrigerator 1 according to the present embodiment includes a body 10 including a refrigerator compartment 30, a freezer compartment 20, a first storage room 110, and a second storage room 120, a refrigerator compartment door 32, a freezer compartment door 22, a first door 430, and a second door 440. The refrigerator compartment door 32, the freezer compartment door 22, the first door 430, and the second door 440 selectively cover the refrigerator compartment 30, the freezer compartment 20, the first storage room 110, and the second storage room 120, respectively.

The first storage 110 is defined in a left upper portion of the body 10 and is selectively covered by the first door 430 that is slidingly withdrawn.

An ice making compartment 460 for receiving an ice making assembly that makes and stores ice is defined in a back surface of the first door 430. The ice making compartment 460 forms a separate closed insulation space isolated from air within the first storage compartment 110. The ice making compartment 460 is defined at an upper or lower portion of the first door 430, like the previously described embodiments. Since an internal configuration of a refrigerator according to the present embodiment is equal to those of the previously described embodiments, detailed descriptions thereof will be omitted.

A receiving part 434 for storing foods may be disposed at a rear side of the first door 430, except for an ice making compartment region. A dispenser 436 for dispensing ice may be disposed in a front surface of the first door 430.

A second storage room 120 is defined in a lower portion of the first storage room 110. The receiving part 434 including at least one or more stages is disposed on the second door 440. The receiving part 434 may be withdrawn together with the first door 430. A plurality of containers including an exclusive vessel may be seated on the receiving part 434, and the receiving part 434 may have various shapes according to kinds of received foods.

The refrigerator may be also applied to various embodiments except for the previously described embodiments. Hereinafter, a refrigerator according to further another embodiment will be described. Components having the same structure as those of the previously described embodiment will be given by the same reference numerals, and thus, detailed descriptions thereof will be omitted.

In the present embodiment, a dispenser is disposed on a back surface of a storage room door, i.e., inside a storage room.

Figure 9:
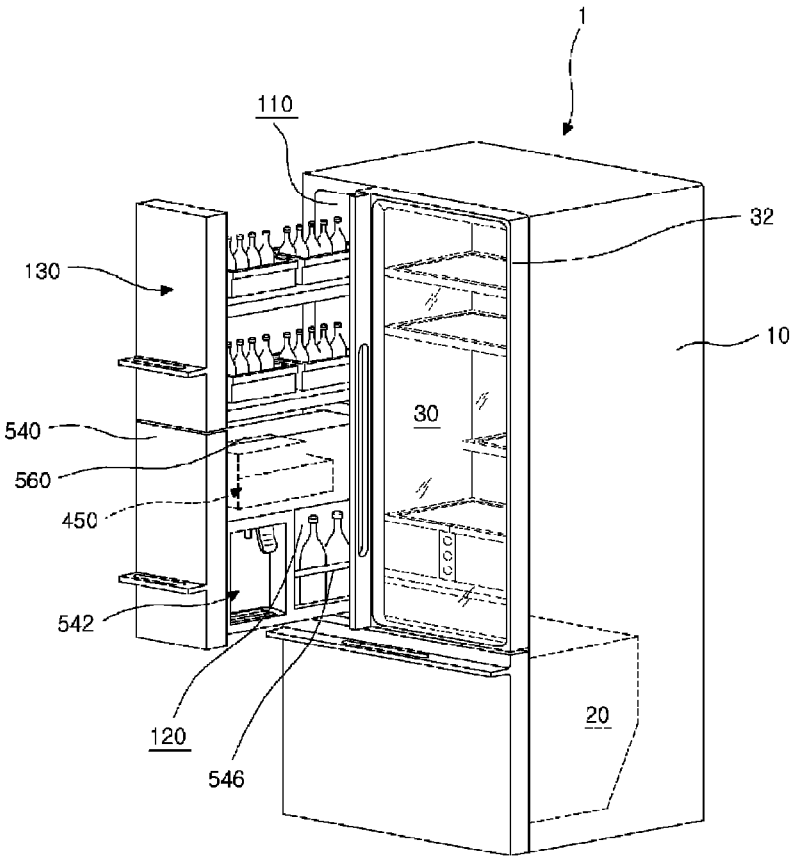
FIG. 9 is a perspective view of a refrigerator according to another embodiment.

FIG. 9 is a perspective view of a refrigerator according to another embodiment.

Referring to FIG. 9, a refrigerator 1 according to the present embodiment includes a body 10 including a refrigerator compartment 30, a freezer compartment 20, a first storage room 110, and a second storage room 120, a refrigerator compartment door 32, a freezer compartment door 22, a first door 130, and a second door 540. The refrigerator compartment door 32, the freezer compartment door 22, the first door 130, and the second door 540 selectively cover the refrigerator compartment 30, the freezer compartment 20, the first storage room 110, and the second storage room 120, respectively.

The first storage 110 is defined in a left upper portion of the body 10 and is selectively covered by the drawer-type first door 130 that is slidingly withdrawn. The second storage room 120 is defined below the first storage room 110 and is selectively covered by the drawer-type second door 540 that is slidingly withdrawn.

An ice making compartment 560 extending backwardly is defined at an upper portion of a back surface of the second door 540. A plurality of components such as an ice making assembly for making and storing ice are disposed inside the ice making compartment 560. In case where the second storage room 120 is maintained as a temperature corresponding to that of the refrigerator, the ice making compartment 560 forms an insulation space independent from the interior of the second storage room 120.

A dispenser 542 and a receiving part 546 are disposed at a lower potion of the ice making compartment 560. The dispenser 542 dispenses ice made within the ice making compartment 560 to the outside. The dispenser 542 may be disposed on a back surface of the second door 540 corresponding to a lower region of the ice making compartment 560.

In detail, the dispenser 542 may be disposed at a side of both sides exposed by withdrawal of the second door 540. That is, the dispenser 542 may be disposed in one-side space of left and right spaces about a surface bisecting the second door 540 into left and right sides. Thus, in order that a user uses the dispenser 542, the second door 540 may be withdrawn to dispense drinking water or ice from a lateral surface or a back surface of a rear side of the second door 540. It is obvious to those skilled in the art that the dispenser 542 is disposed on the back surface corresponding to a central region of the second door 520.

The receiving part 546 is disposed below the ice making compartment 560 and does not interfere with the dispenser 542 to easily receive foods. That is, the receiving part 546 may include a lower region of the ice making compartment 560, except for the dispenser 542.

The refrigerator may be also applied to various embodiments except for the previously described embodiments. Hereinafter, a refrigerator according to further another embodiment will be described. Components having the same structure as those of the previously described embodiment will be given by the same reference numerals, and thus, detailed descriptions thereof will be omitted.

In the present embodiment, size of storage rooms partitioned in plurality are different from each other, and a portion of a door for opening and closing one storage room covers at least portion of the other storage room.

Figure 10:
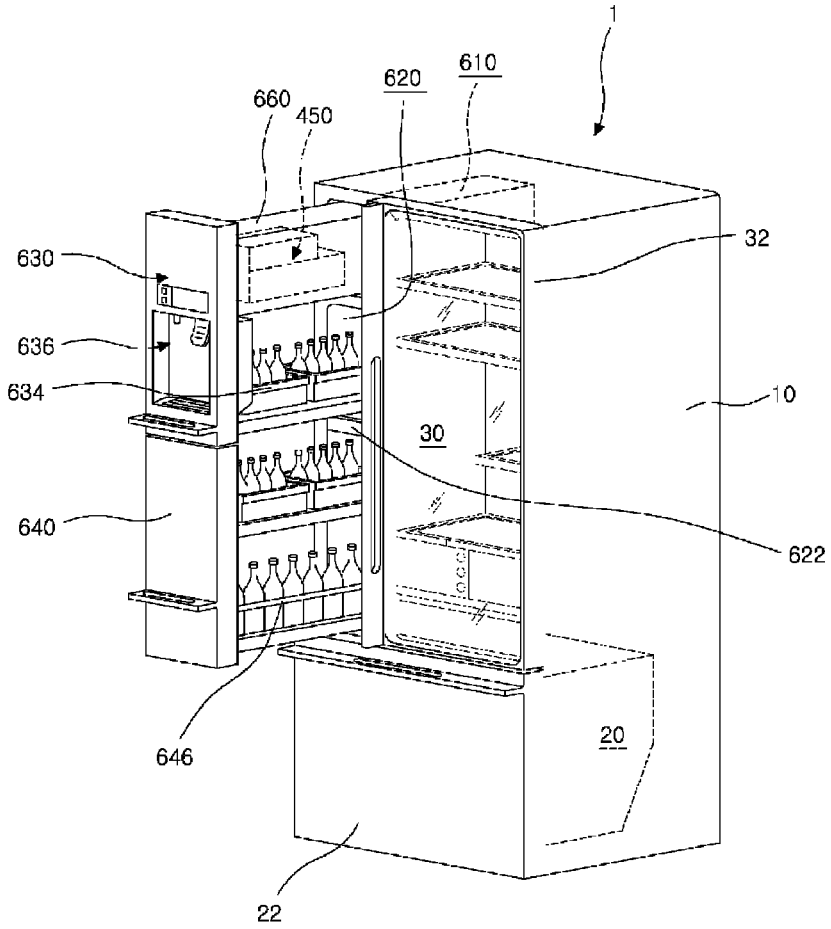
FIG. 10 is a front perspective view of a refrigerator according to another embodiment.
Figure 11:
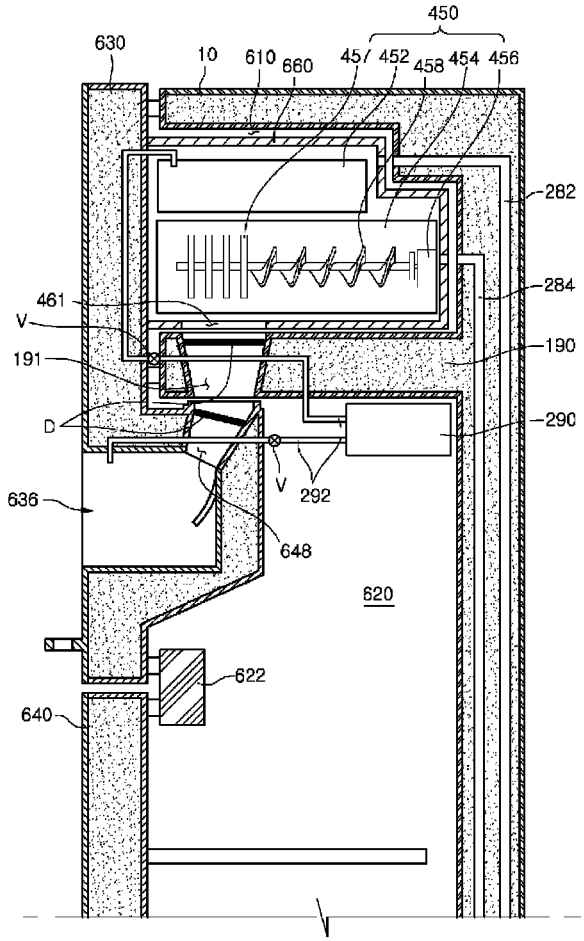
FIG. 11 is a side cross-sectional view of the refrigerator.

FIG. 10 is a front perspective view of a refrigerator according to another embodiment, and FIG. 11 is a side cross-sectional view of the refrigerator.

Referring to FIGS. 10 and 11, a refrigerator 1 according to the present embodiment includes a body 10 including a refrigerator compartment 30, a freezer compartment 20, a first storage room 610, and a second storage room 620, a refrigerator compartment door 32, a freezer compartment door 22, a first door 630, and a second door 640. The refrigerator compartment door 32, the freezer compartment door 22, the first door 630, and the second door 640 selectively cover the refrigerator compartment 30, the freezer compartment 20, the first storage room 610, and the second storage room 620, respectively.

In the present embodiment, the first door 630 has an area greater than that of an opened front surface of the first storage room 610 to cover at least portion of a front surface of the second storage room 620. An ice making assembly 450 and a dispenser 636 are disposed on a back surface of the first door 630. Also, the ice making assembly 450 is received into the first storage room 610, and the dispenser 636 is received into the second storage room 620.

In detail, the first storage room 610 is defined at a left upper portion of the body 10 corresponding to a left side of the refrigerator compartment 30. The first storage room 610 may have a size corresponding to that of an ice making compartment 660 that will be described below.

That is, the first storage room 610 may have only a size in which the ice making compartment 660 is received. The ice making compartment may be maintained at a temperature below zero at which ice can be made, i.e., a temperature corresponding to the freezer compartment. On the other hand, the second storage room 620 may be defined as a separate space below the firs storage room 610. The second storage room 620 may have a length greater than that of the first storage room 610. An internal temperature of the second storage room 620 may be changeable to allow the second storage room 620 to be used as a refrigerator compartment or a freezer compartment according to a user s selection.

The first storage room 610 and the second storage room 620 are selectively covered by the first door 630 and the second door 640 that are slidingly withdrawn, respectively.

In detail, the first door 630 covers an entire front surface of the first storage room 610 and a portion of an upper front surface of the second storage room 620. The first door 630 may have a vertical length greater than that of the first storage room 610. In further detail, the vertical length of the first storage room 610 may be shorter than that of the second storage room 620. The first door 630 and the second door 640 may have the same vertical length as each other. At least the first door 630 may have a vertical length longer than that of the first storage room 610.

An ice making compartment 660 is defined on a back surface of the first door 630.

An ice making assembly 450 for making and storing ice is received into the ice making compartment 660. The ice making compartment 660 has a size corresponding to that of the first storage room 610. The ice making compartment 660 may be formed as an insulation space isolated from the outside, or a portion or the whole of the interior of the ice making compartment 660 may be exposed.

A dispenser 636 for dispensing drinking water and ice may be disposed in a front surface of the first door 630. The dispenser 636 may be near to a lower end of the first door 630 when compared to an upper end of the first door 630. The dispenser 636 communicates with the ice making compartment 660 to dispense the ice within the ice making room to the outside. In detail, since the dispenser 636 is further near to the lower end of the first door 630, a user having a small height such as a child may easily dispense the ice and water.

A receiving part 634 may be disposed on the back surface of the first door 630 corresponding to a lower region of the ice making compartment 660. The receiving part 634 may be provided in up-and-down two stages or one stage. The receiving part 634 may have various structures according to types of foods.

For example, the receiving part 634 may have a structure similar to a shelf or a rack structure or a basket shape. Also, various structures such as a structure that is vertically adjustable or a structure that is slidingly withdrawable in front and rear directions may be applicable.

The second door 640 is disposed below the first door 630. The second door 640 is slidingly withdrawable from the second storage room 620. The second door 640 extends up to a length that can cover a lower side of the second storage room 620 that is not covered by the second door 640.

A receiving part 646 may be disposed on the back surface of the second door 640. The receiving part 646 may be provided in one stage or two stages according to a vertical length of the second door 640.

A frame 622 extending horizontally may be disposed on a front surface of the second storage room 620 corresponding to a region in which a lower end of the first door 630 is in contact with an upper end of the second door 640. The frame 622 may include a barrier that is in contact with a gasket surrounding a back surface of a lower end portion of the first door 630 and a back surface of an upper end portion of the second door 640 to lock tightly cool air.

Thus, it may prevent the cool air form leaking through a portion at which the first door 630 is in contact with the second door 640 even if the second storage room 620 is partitioned into two spaces.

The refrigerator may be also applied to various embodiments except for the previously described embodiments. Hereinafter, a refrigerator according to further another embodiment will be described. Components having the same structure as those of the previously described embodiment will be given by the same reference numerals, and thus, detailed descriptions thereof will be omitted.

In the present embodiment, a plurality of storage rooms has sizes different from each other, like the previously described embodiment. However, it is different that each of doors has a size in which only a corresponding storage room is opened and closed.

Figure 12:
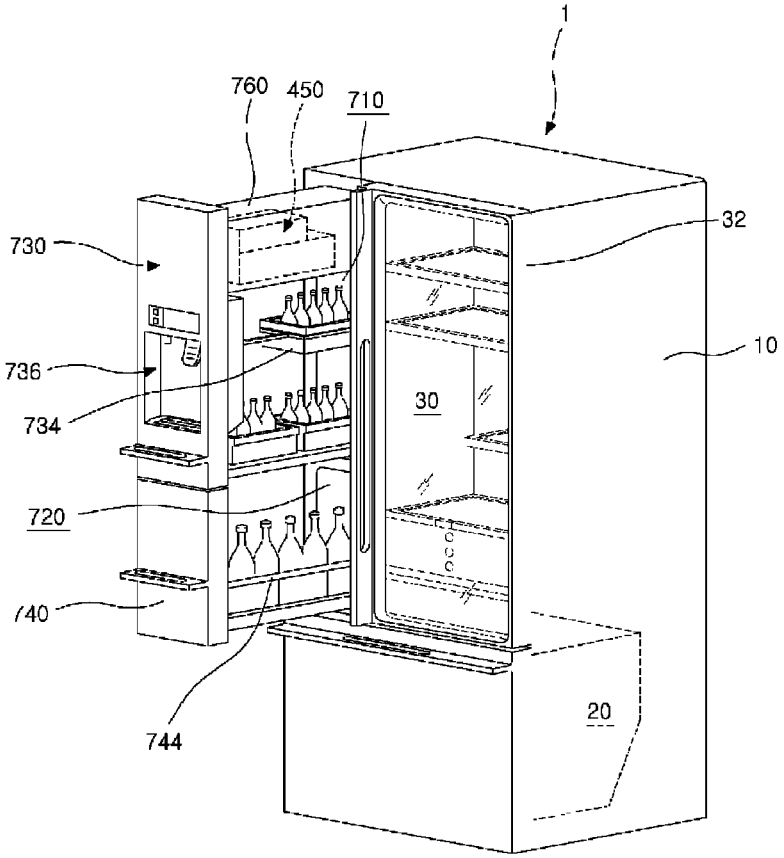
FIG. 12 is a front perspective view of a refrigerator according to another embodiment.

FIG. 12 is a front perspective view of a refrigerator according to another embodiment.

Referring to FIG. 12, a refrigerator 1 according to the present embodiment includes a body 10 including a refrigerator compartment 30, a freezer compartment 20, a first storage room 710, and a second storage room 720, a refrigerator compartment door 32, a freezer compartment door 22, a first door 730, and a second door 740. The refrigerator compartment door 32, the freezer compartment door 22, the first door 730, and the second door 740 selectively cover the refrigerator compartment 30, the freezer compartment 20, the first storage room 710, and the second storage room 720, respectively.

The first storage room 710 and the second storage room 720 may have vertical lengths different from each other. Also, the first door 730 and the second door 740, which open and close the first storage room 710 and the second storage room 720, respectively, may have vertical lengths different from each other. As described above, the first door 730 may have a size in which only the first storage room 710 is opened and closed, and the second door 740 may have a size in which only the second storage room 720 is opened and closed.

In detail, the first storage room 710 is defined at a left upper portion of the body 10 corresponding to a left side of the refrigerator compartment 30. The first storage room 710 may be maintained at a temperature corresponding to that of the refrigerator compartment or the freezer compartment by cool air supplied from an evaporator. The first storage room 710 may be separated from the second storage room 720 by a partition.

The first storage room 710 may have a vertical length longer than that of the second storage room 720. Thus, the first door 730 covering the first storage room 710 may have a vertical length longer than that of the second door 740.

An ice making compartment 760 extending backwardly is disposed on a back surface of the first door 730. An ice making assembly 450 for making and storing ice is received into the ice making compartment 760. The ice making compartment 760 may be integrally formed with the back surface of the first door 730, and thus, may be withdrawn together with the first door 730 when the first door 730 is withdrawn.

When the first storage room 710 is maintained at a temperature corresponding to that of the refrigerator compartment, the ice making compartment 760 may form an independent insulation space isolated from the first storage room 710. That is, the ice making compartment 760 may form an independent space within the first storage room 710 by a separate insulation wall structure. At least portion of the ice making compartment 760 may be selectively opened and closed by a user to easily service and clean the ice making compartment 760.

A receiving part 754 may be disposed on a back surface of the first door 730 corresponding to a lower region of the ice making compartment 760. The receiving part 754 may be provided in one stage or two stages according to a vertical length of the first door 730. Also, the receiving part 754 may have various structures to receive various foods.

A dispenser 736 for dispensing the ice supplied from the ice making compartment 760 to the outside may be disposed in a front surface of the first door 730. The dispenser 736 may be disposed below the ice making compartment 760, and also may be disposed at a position near to a lower end of the first door 730.

That is to say, the first door 730 may have a length in which the user has access to the dispenser 736 to easily dispense drinking water and the made ice.

The second storage room 720 may be disposed below the first storage room 710. The second storage room 720 may have a vertical length somewhat shorter than that of the first storage room 710. The second storage room 720 may be maintained at a temperature corresponding to that of the refrigerator compartment or the freezer compartment. The second storage room 720 may be selectively covered by the second door 740 that is slidingly withdrawn.

The second door 740 has a size corresponding to that of an opened front surface of the second storage room 720. A receiving part 744 for receiving foods may be disposed on a back surface of the second door 740. Thus, when the second door 740 is opened, the second storage room 720 may be opened also to expose the receiving part 744 to the outside, thereby to receive the foods.

The receiving part 744 may have various structures according to kinds of foods. The receiving part 744 may be provided in one stage or two stages according to a vertical length of the second door 740.

Figure 13:
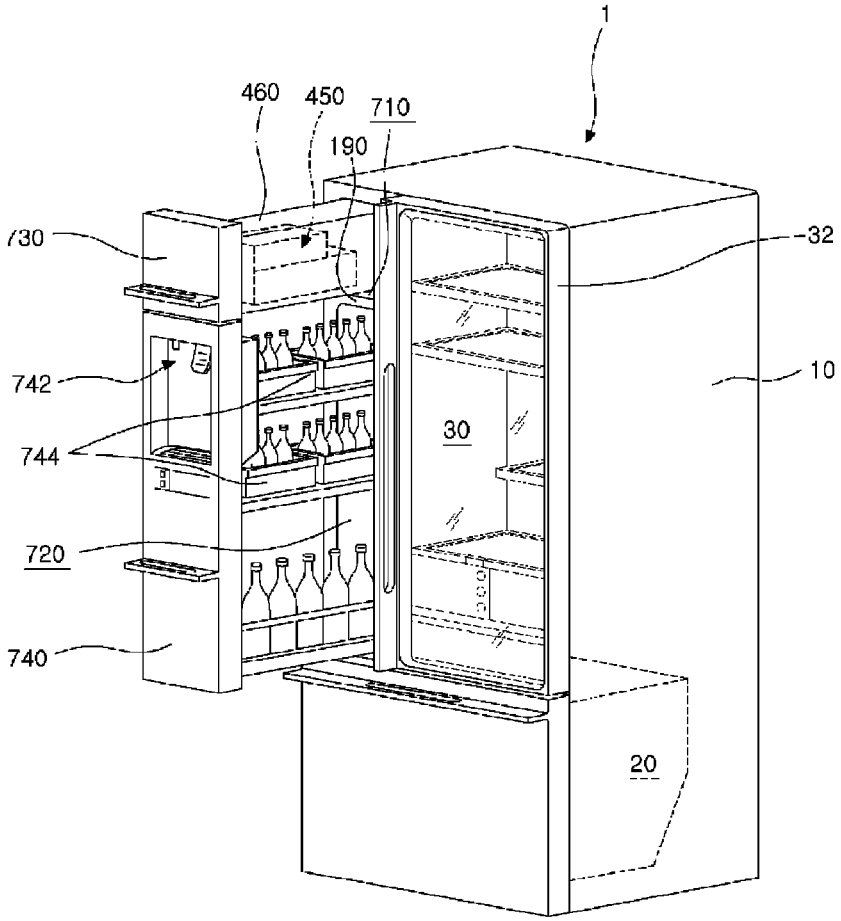
FIG. 13 is a front perspective view of a refrigerator according to another embodiment.
Figure 14:
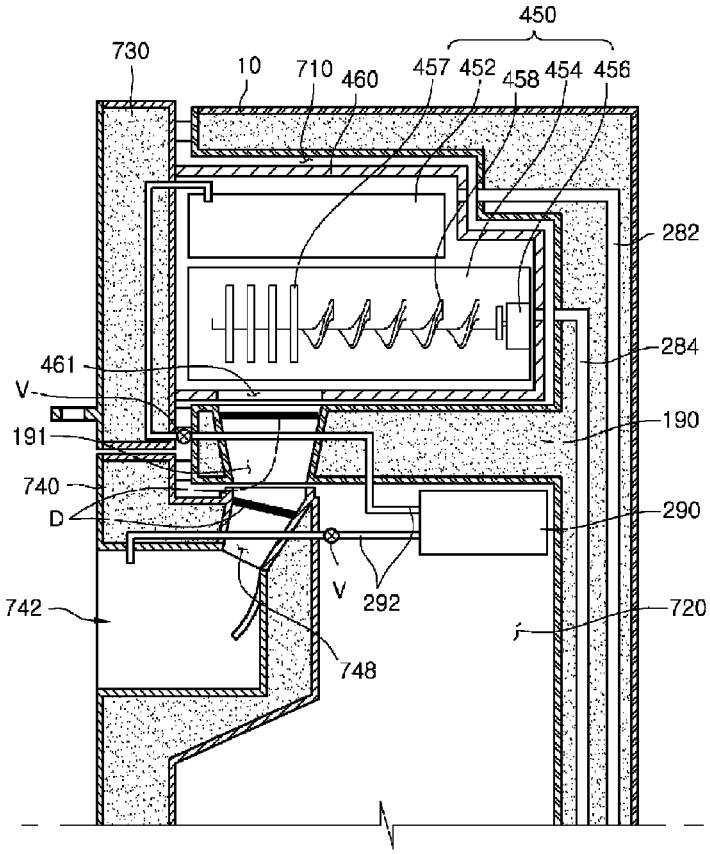
FIG. 14 is a partial cross-sectional view of a refrigerator according to the embodiment.

FIG. 13 is a front perspective view of a refrigerator according to another embodiment, and FIG. 14 is a partial cross-sectional view of a refrigerator according to the embodiment.

In the present embodiment, a storage rooms is vertically partitioned, and an ice making assembly is disposed in a space different from a dispenser. Thus, the ice making assembly and the dispenser are disposed on doors different from each other, respectively.

Referring to FIGS. 13 and 14, a separate storage room for receiving a drawer-type door is provided at a lateral surface of a refrigerator compartment 30 of a refrigerator 1, and the storage room is separated from the refrigerator compartment 30.

In detail, the storage room is partitioned into a first storage room 710 and a second storage room 720 defined below the first storage room 710 by a partition 190. The first storage room 710 is selectively covered by a first door 730, and the second storage room 720 is selectively covered by a second door 740. An ice making compartment is disposed on a back surface of the first door 730, and an ice making assembly 450 is received into the ice making compartment 460. As described above, the ice making assembly 450 includes a transfer unit including an ice maker 452, an ice bank 454, an auger 458, and a crusher 457 and an electric motor 456 for operating the transfer unit.

In case where the first storage room 710 is used as a freezer compartment, an insulation wall structure defining the ice making compartment 710 may be not necessary. The second storage room 720 may be converted into one of the refrigerator compartment and the freezer compartment.

A supply duct 282 for supplying cool air and a return duct 284, by which the cool air supplied into the ice making compartment 460 or the first storage room 710 returns to an evaporator, extend into a wall defining a body 10. A dispenser 742 for dispensing ice stored in the ice bank 454 or drinking water is disposed in a front surface of the second door 740. A receiving part 744 is disposed on a back surface of the second door 740 corresponding to a rear side of the dispenser 742. According to a design method, the dispenser 736 may have a structure for dispensing only the ice, and a structure for dispensing the drinking water may be not provided. An ice making assembly 450 and/or a water tank 290 for supplying water into a drinking water dispensing hole disposed in the dispenser 742 are disposed inside the second storage room 720. Here, a water supply passage 292 extends from the water tank 290. Since the first door 730 and the second door 740 are slidingly withdrawn, the water supply passage 292 may be detachably coupled to the water tank 290. That is to say, when the first door 730 and/or the second door 740 are/is withdrawn in a front direction, the water supply passage 292 may be separated from the water tank 290. Also, when the first door 730 and/or the second door 740 are/is completely closed, the water supply passage 292 may be variably connected to the water tank 290. At this time, a sealing structure for preventing the water from leaking through a portion connecting the water supply passage 292 to the water tank 290.

An ice chute 748 for discharging the ice stored in the ice bank 454 toward the dispenser 742 is disposed in the back surface of the second door 740. A discharge hole 461 for discharging the ice is defined at a side of a bottom surface of the ice bank 454. In case where the ice making assembly 450 is received into the ice making compartment 450, the discharge hole 461 may be defined in at least one bottom surface of insulation walls defining the ice making compartment 460. A discharge duct 191 connecting the discharge hole 461 to the ice chute 748 is disposed in the partition 190. A damper D may be disposed inside the discharge duct 191. A distance between the ice making assembly 450 including the ice bank 454 and the ice chute 748 may be minimized to improve utilization of inner spaces of the storage rooms 710 and 720. Thus, it is advantageous that the ice making assembly 450 is disposed at a position maximally near to a top surface of the partition 190, and the ice chute 748 is disposed at a position maximally near to a bottom surface of the partition 190. In case where the ice making assembly 450 and the ice chute 748 are spaced a predetermined distance from the partition 190, an inner space of the storage room corresponding to the spaced distance may not receive foods. Thus, it is advantageous that a bottom surface of the ice making assembly 450 or the ice making room 460 is near to the top surface of the partition 190, and an upper end of the ice chute 748 is near to the bottom surface of the partition 190. In this case, the dispenser 742 may be disposed at a position further near to an upper end of the second door 740. Thus, a vertical length of the dispenser 742 may extends vertically so that a position of the bottom is not changed. Therefore, a user having a small height such as a child easily dispenses the ice and water through the dispenser 742.

Since the ice making compartment 460 including the ice making assembly 450 is received into the first storage room 710, and the dispenser 742 is received into the second storage room 720, it may obtain the following effects. That is, the ice making assembly 450 is hardly exposed to the outside of the refrigerator 1 except for a repair due to malfunction. Also, ice making efficiency may be reduced when the ice making assembly 450 is frequently exposed to the outside. Thus, to overcome the above-described limitation, the ice making assembly 450 should be disposed in a separate space within the first storage room 710. The dispenser 742 is disposed in the second door 740. When the second storage room 720 is maintained at a temperature corresponding to that of the refrigerator compartment, it may prevent the water supply passage 292 and the water tank 290 from being frozen over.

Although a separate water storage container such as the water tank 290 is disposed inside the refrigerator 1 in the present embodiment, the present disclosure is not limited thereto. For example, as shown in FIG. 6, the water supply passage may be directly connected to a water supply source.

Also, in the present embodiment, a slight modification may be applied to form the following structure. Although not shown, it is obvious to those skilled in the art that the following structure may be applicable to the present embodiment.

In detail, the second door 740 may be partitioned into a dispenser region and other regions to form two doors. That is, the second door 740 may be divided into two doors to cover the second storage room 720 by the second door 720. For example, the refrigerator 1 may include a first door covering the ice making compartment 460 received into the first storage room 710, a second door covering a portion of the second storage room 720 and including the dispenser and the receiving part, and a third door covering a portion of a lower side of the second storage room 720 and including only the receiving part.

Figure 15:
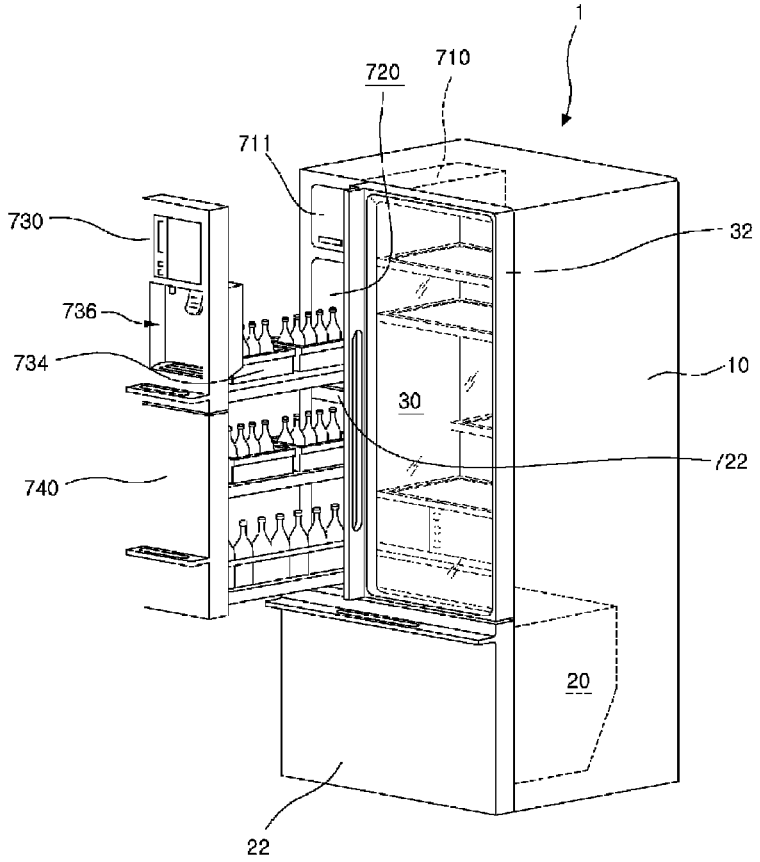
FIG. 15 is a front perspective view of a refrigerator according to another embodiment.
Figure 16:
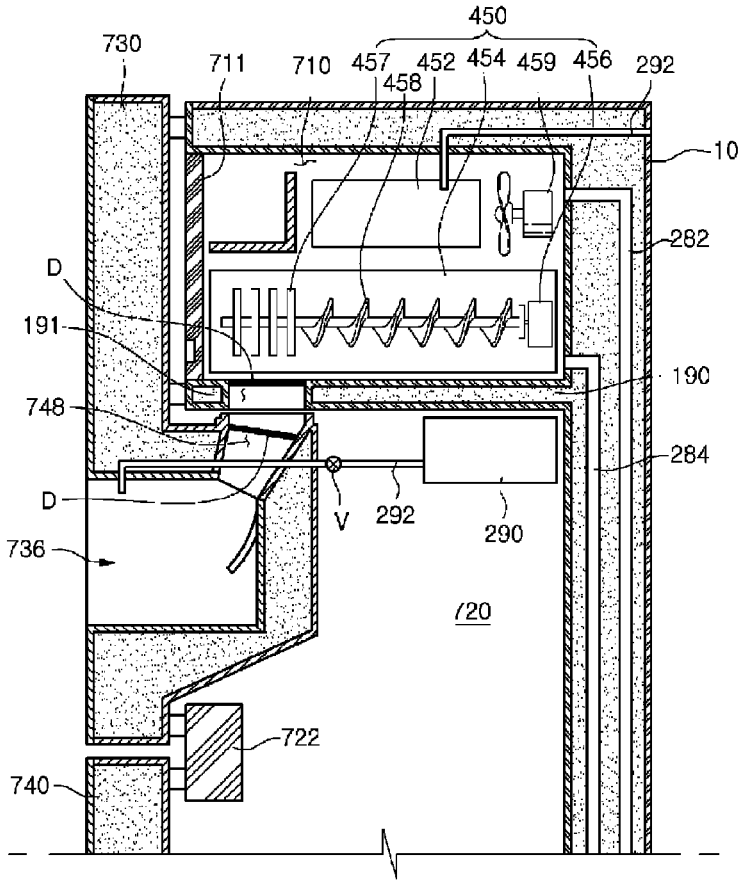
FIG. 16 is a partial cross-sectional view of a refrigerator according to the embodiment.

FIG. 15 is a front perspective view of a refrigerator according to another embodiment, and FIG. 16 is a partial cross-sectional view of a refrigerator according to the embodiment.

In the present embodiment, an ice making assembly is fixed inside a storage room, and only a dispenser is disposed on a back surface of the storage room and is withdrawn together with a door.

Referring to FIGS. 15 and 16, in a refrigerator 1 according to the present embodiment, a separate storage room is defined at a lateral surface of a refrigerator compartment 30. The storage room is partitioned into an upper region and a lower region by a partition 190. An ice making assembly is fixed to one of the partitioned storage rooms.

In detail, the storage room is partitioned into a first storage room 710 and a second storage room 720, like the previously described embodiment. The first storage room 710 and the second storage room 720 are selectively covered by a first door 730 and a second door 740, respectively. The first door 730 and the second door 740 are provided in a drawer-type. An ice making assembly 450 is fixed inside the first storage room 710, and a dispenser 736 is disposed on a back surface of the second door 740. Hereinafter, components having the same structure as those of FIGS. 13 and 14 will be given by the same reference numerals.

In detail, an opened front surface of the first storage room 710 may be covered by an insulation wall 711. The first storage room 710 may be maintained at a temperature corresponding to that of a freezer compartment 20. An ice making assembly 450 is fixed inside the first storage room 710. As described above, the ice making assembly 450 may include an ice maker 452, an ice bank 454, an electric motor 456, a crusher 457, and an auger 458. The ice making assembly 450 may further include a cooling fan 459 according to a design condition. The cooling fan 459 uniformly distributes cool air supplied from a supply duct 282 to the inside of the first storage room 710 and quickly supplies the cool air into the ice maker 452. A structure of the cooling fan 459 may be applicable in the same manner to the previously described embodiments.

A water tank 290 is disposed inside the second storage room 720. A water supply passage 292 is detachably connected to the water tank 290. Although the water supply passage 292 for supplying water into the ice maker 452 is directly connected to a water supply source along a well defining a refrigerator body 10 in the present embodiment, the present disclosure is not limited thereto. For example, the same structure as those of the embodiments shown in FIGS. 13 and 14 may be applicable in the present embodiment.

In the present embodiment, a portion of the first door 730 covers a portion of an upper side of the second storage room 740. Thus, a frame 722 for preventing cool air from leaking is disposed at a front side of the second storage room 720 corresponding to a region in which a lower end of the first door 730 is in contact with an upper end of the second door 740. That is, a gasket disposed on a back surface of the lower end of the first door 730 and a gasket disposed on a back surface of the upper end of the second door 740 are closely attached to a front surface of the frame 722 to prevent the cool air from leaking.

In another embodiment, when the first door 730 has a size in which only the first storage room 710 is covered, a separate frame may be not necessary, and the partition 190 may serve as the frame.

Also, in the present embodiment, a dispensing structure for dispensing drinking water may be not provided in the dispenser 736, and only an ice dispensing structure may be provided in the dispenser 736. In this case, the water supply tank 290 and the water supply passage 292 for supplying the drinking water may be not necessary.

According to the above-described structure, like the previously described embodiment, when the first door 730 is withdrawn, the ice making assembly 450 is maintained in a state in which the ice making assembly 450 is fixed inside the first storage room 710. That is, since the ice making assembly 450 need not be frequently exposed to the outside by a user, the ice making assembly 450 is not exposed to the outside even if the doors 730 and 740 are withdrawn.

In the present embodiment, since the ice making assembly 450 is fixed inside the first storage room 710, a separate insulation wall structure surrounding the entire ice making assembly 450 need not be provided. That is, it may be enough to provide only the insulation wall 711. However, a separate insulation wall defining the ice making compartment may be provided according to a design condition. The insulation wall 711 may be pivotably provided about an upper end thereof to allow the ice making assembly 450 to be separated.

The two doors for respectively opening and closing the first storage room 710 and the second storage room 720 may be integrally formed in one body. That is, the first door 730 and the second door 740 are not divided, i.e., a single door may be provided to selectively open and close the first storage room 710 and the second storage room 720. This structure is referred to as a plurality of storage rooms/single door structure. In this case, when the second storage room 720 is opened, the first storage room 710 may be opened together. However, the insulation wall 711 may prevent an external air from being introduced into the first storage room 710. Also, in case of the single door structure, the frame 722 need not be provided.

On the other hand, the first door 730 may be divided into two doors.

In detail, the first door 730 may be divided into an upper door for covering only the ice making compartment 710 and a lower door including the dispenser. The upper door may open and close the ice making compartment instead of the insulation wall 711. A dispenser 736 may be disposed in the lower door, and a receiving part may be disposed at a rear side of the dispenser 736. Thus, the second storage room 720 may be opened and closed by the lower door including the dispenser 736 and the second door 740. This structure is referred to as a plurality of storage rooms/a plurality of doors structure. That is, one door may open and close a portion or the whole of one storage room.

Figure 17:
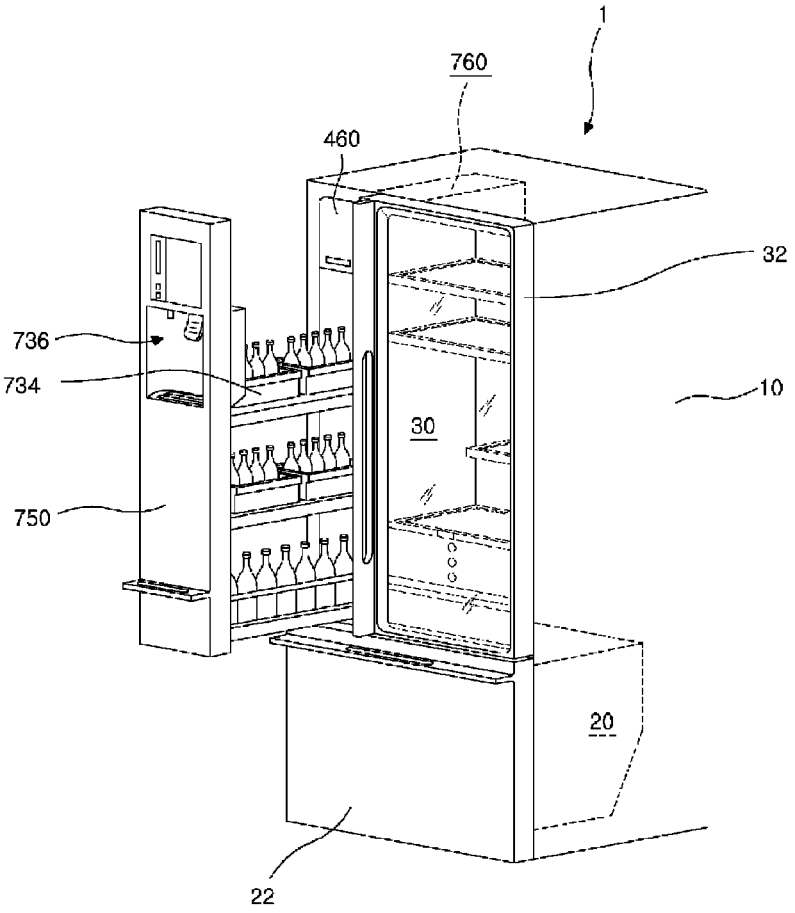
FIG. 17 is a front perspective view of a refrigerator according to another embodiment.
Figure 18:
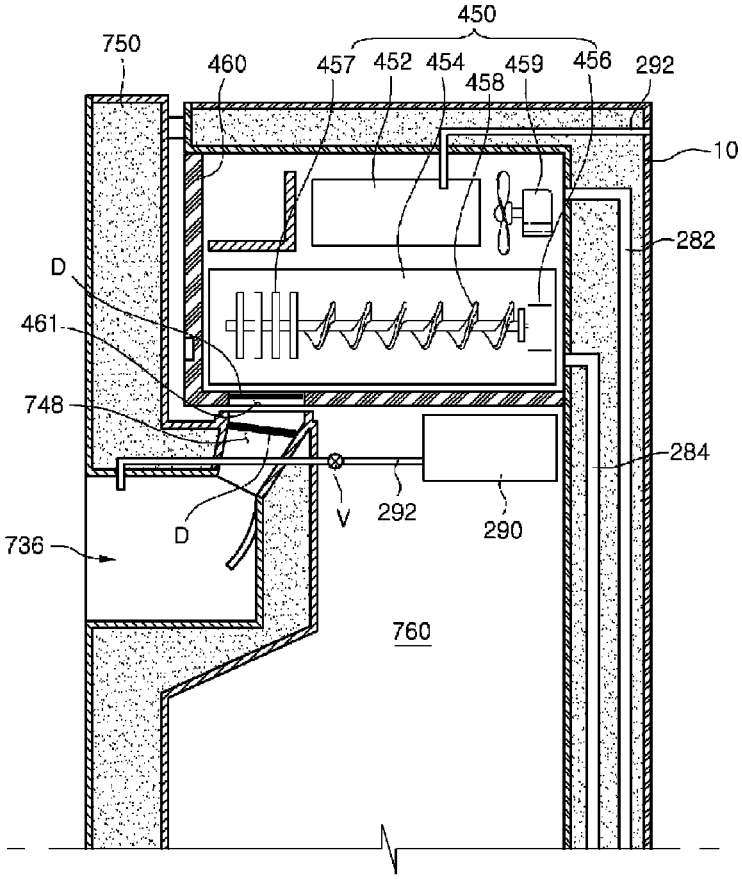
FIG. 18 is a partial cross-sectional view of a refrigerator according to the embodiment.

FIG. 17 is a front perspective view of a refrigerator according to another embodiment, and FIG. 18 is a partial cross-sectional view of a refrigerator according to the embodiment.

In the present embodiment, an ice making assembly is fixed inside a storage room, and only a dispenser is disposed on a back surface of a door for opening and closing the storage room. Thus, the storage room forms one space.

Referring to FIGS. 17 and 18, a refrigerator 1 according to the present embodiment includes a refrigerator compartment 30, a freezer compartment 20, and a storage room 760 defined at a side of the refrigerator compartment 30.

In detail, the storage 760 is provided in one space, and an ice making compartment 460 is defined above the storage room 760. As described above, the ice making compartment may be separated from the storage room 760 by a separate insulation wall structure. According to the separate insulation wall structure, an internal temperature of the ice making compartment 460 may be different from that of the storage room 760. An ice making assembly 450 is received into the storage room 760. The storage room 760 includes an ice maker 452, an ice bank 454, an electric motor 456, a crusher 457, and an auger 458, and/or a cooling fan 459. A front surface of one of insulation walls defining the ice making compartment 460 may be pivotably disposed about an edge portion of a side thereof to allow the ice making assembly 450 to be separated. A discharge hole 461 for discharging ice is defined in a bottom surface of one of the insulation walls defining the ice making compartment 460.

An opened front surface of the storage room 760 is selectively covered by a door 750. The door 750 may have a configuration and size in which the first door and the second door of the previously described embodiment are integrally formed in one body. A dispenser 736 is disposed at a side of the door 750. That is, a recess portion for receiving a container is disposed on a front surface of the door 750, and an ice chute 748 for guiding a discharge of ice is disposed in a back surface of the door 750. When the door 750 is completely closed, an upper end of the ice chute 748 communicates with the discharge hole 461. Thus, the ice discharged from the ice bank 456 passes through the discharge hole 461, is guided by the ice chute 748, and is discharged from the dispenser 736.

Although not shown, the ice making compartment 460 may be disposed on the back surface of the door 750 to provide a structure in which the ice making compartment 460 is withdrawn together with the door 750. This will be construed as being included in the present disclosure.

Also, the door 750 may be partitioned into two doors, and the storage room 760 may be also partitioned into two storage rooms. It may be easily modified from FIGS. 17 and 18 by those skilled in the art. That is to say, the door 750 may be partitioned into a first door including the dispenser 736 and/or the receiving part and a second door including only the receiving part. Also, the storage room 760 corresponding to the door 750 may be partitioned into a first storage room receiving the ice making assembly 460 and a rear end portion of the dispenser 736 and a second storage room receiving the receiving part disposed on the second door. Thus, the partitioned first storage room may be opened and closed by the first door, and the partitioned second storage room may be opened and closed by the second door. Of course, the ice making assembly 460 is fixed inside the partitioned first storage room. This structure is referred to as a plurality of storage rooms/a plurality of doors structure. Thus, one door may open and close one storage room.

Figure 19:
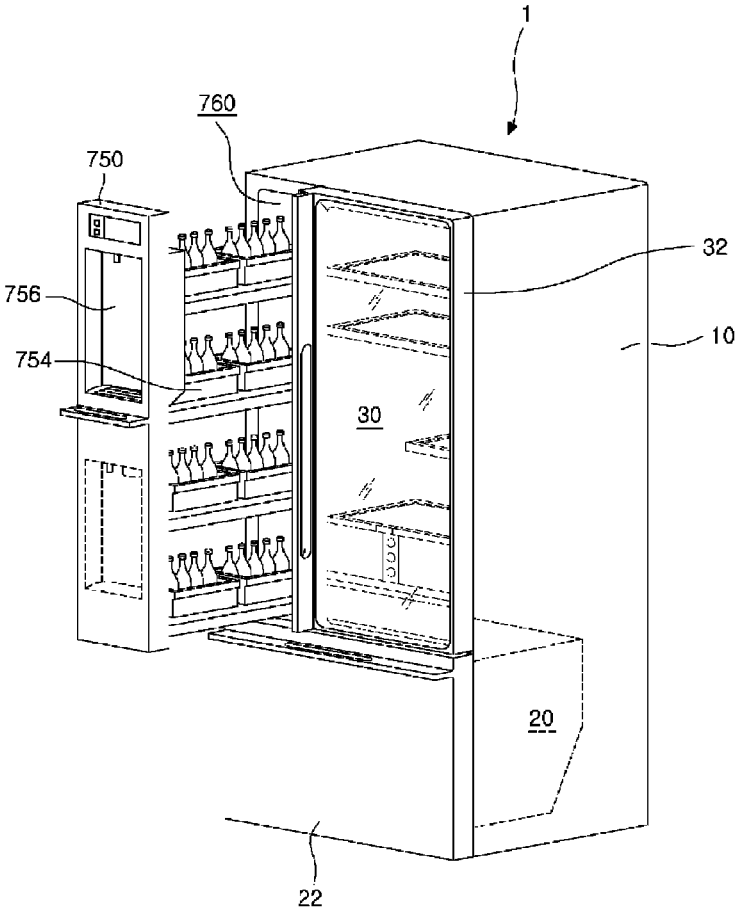
FIG. 19 is a front perspective view of a refrigerator according to another embodiment.
Figure 20:
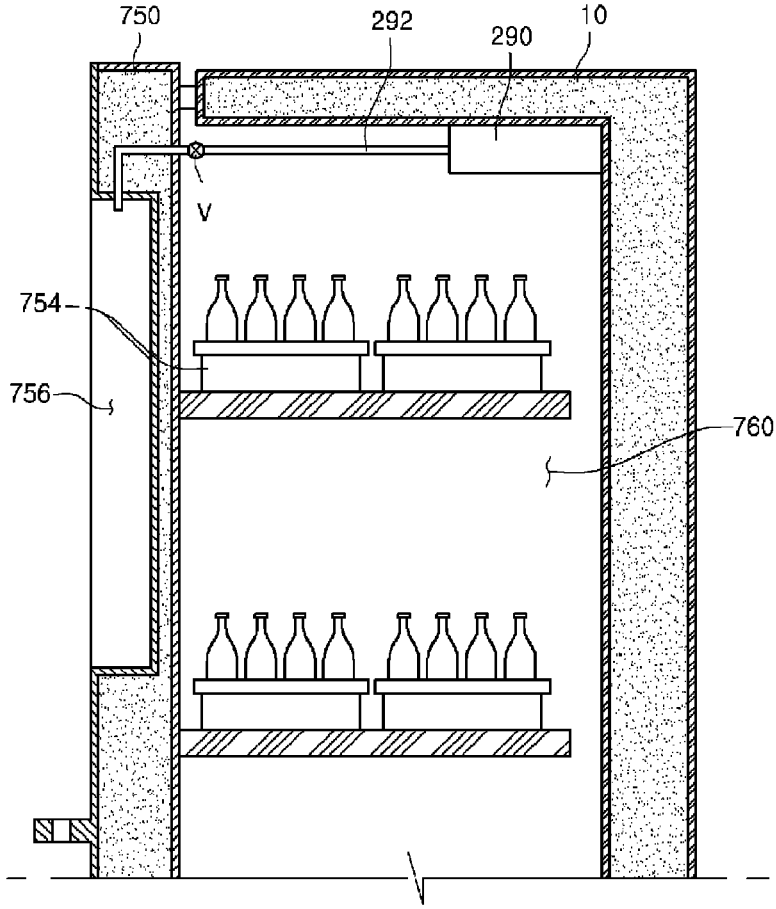
FIG. 20 is a partial cross-sectional view of a refrigerator according to the embodiment.

FIG. 19 is a front perspective view of a refrigerator according to another embodiment, and FIG. 20 is a partial cross-sectional view of a refrigerator according to the embodiment.

In the present embodiment, a storage room separated from a refrigerator compartment and a freezer compartment and a door for opening and closing the storage room are provided in one space and a single door to provide only a dispenser for dispensing drinking water within the door.

Referring to FIGS. 19 and 20, a body 10 of a refrigerator 1 according to the present embodiment includes a refrigerator compartment 30, a freezer compartment 20, and a storage room 760. The storage room 760 is covered by a drawer-type door 750 that is slidingly withdrawn.

In detail, at least one or more receiving parts are disposed on a back surface of the door 750. A variety of containers is seated on the receiving parts 754. A dispenser 756 having a recessed shape and dispensing drinking water is disposed in a front surface of the door 750. A water supply passage 292 extends up to a top surface of the dispenser 756.

In further detail, a water tank 290 is disposed inside the storage room 760. The water supply passage 292 extends from the water tank 290 up to the dispenser 256. As shown in FIG. 20, the separate water tank 290 for supplying the drinking water may be provided. Alternatively, the water supply passage 292 may be directly connected to a water supply source.

The water supply passage 292 has one end detachably connected to the water tank 290. Thus, when the door 750 is opened, the water supply passage 292 is separated from the water tank 290, and when the door 750 is completely closed, the water supply passage 292 is coupled to the water tank 290.

Although the dispenser 756 is disposed at an upper portion of the door 750 in the present embodiment, the present disclosure is not limited thereto. For example, like a dotted portion shown in FIG. 19, the dispenser 756 may be disposed at a position near to the door 750. Therefore, a user having a small height such as a child may easily dispense ice and water.

Also, although a dispenser for dispensing ice is not provided, and only a dispenser for dispensing drinking water is provided in the present embodiment, as well as, the door 750 for opening and closing the storage room 737 is provided in only one as an example, the present disclosure is not limited thereto. For example, the door 750 for opening and closing the storage room may be provided in plurality, like the previously described embodiment.

For example, doors for opening and closing the storage room may be disposed at upper and lower sides, respectively, and a dispenser for dispensing the drinking water may be disposed on any one door. Also, the storage room 760 may be partitioned into a plurality, and the partitioned storage rooms may be maintained at temperatures different from each other.

Figure 21:
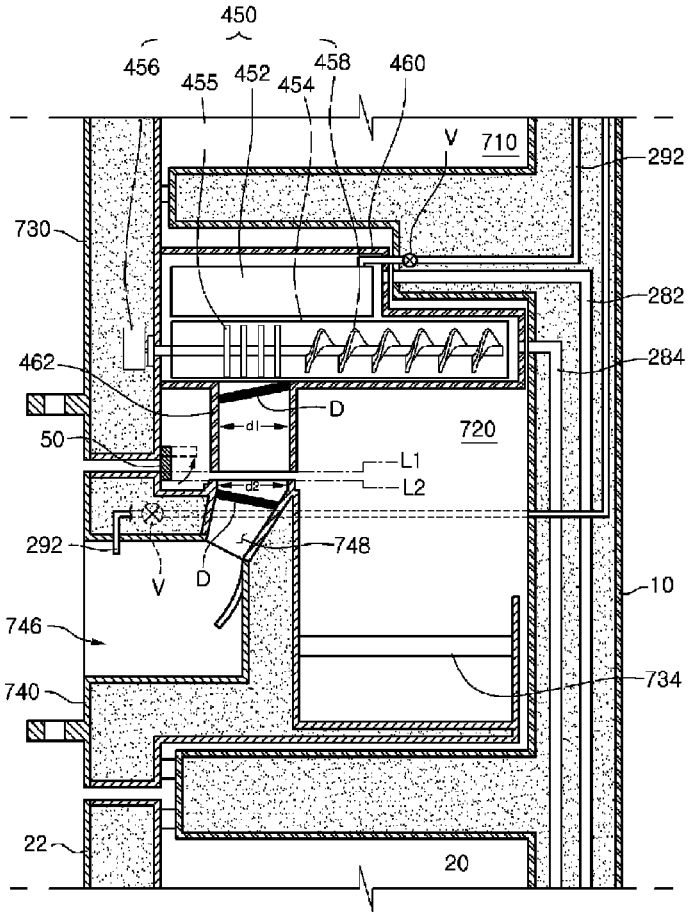
FIG. 21 is a vertical cross-sectional view of a refrigerator according to another embodiment.
Figure 22:
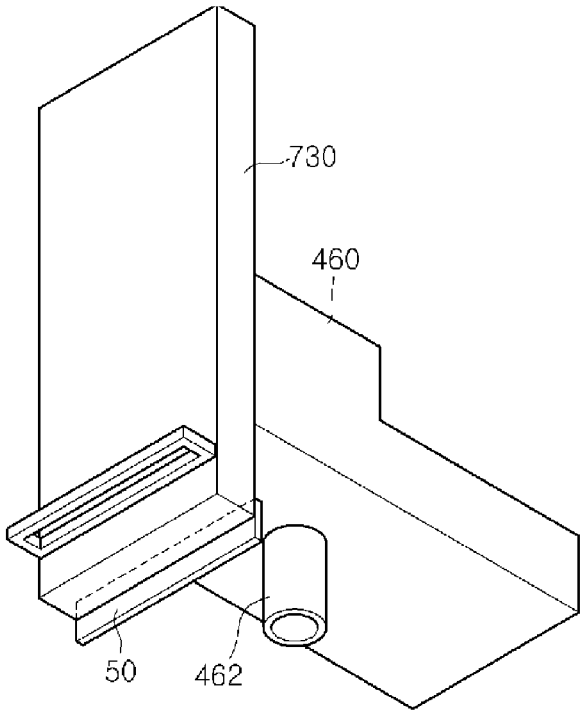
FIG. 22 is a bottom perspective view illustrating a first door of a refrigerator according to the embodiment.
Figure 23:
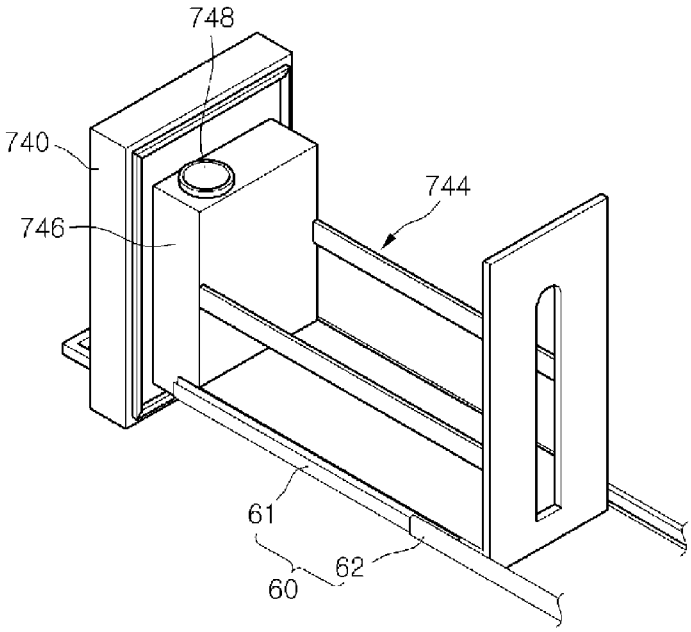
FIG. 23 is a rear perspective view illustrating a second door of a refrigerator according to the embodiment.

FIG. 21 is a vertical cross-sectional view of a refrigerator according to another embodiment, FIG. 22 is a bottom perspective view illustrating a first door of a refrigerator according to the embodiment, and FIG. 23 is a rear perspective view illustrating a second door of a refrigerator according to the embodiment.

Referring to FIGS. 21 to 23, in the present embodiment, a first door 730 covers the whole of a first storage room 710 and a portion of a second storage room 720. A second door 740 covers a remaining portion of the second storage room 720. Moreover, an ice making assembly 450 is disposed on a back surface of the first door 730 corresponding to a region in which the portion of the second storage room 720 is covered. A dispenser 746 for dispensing ice and/or water is disposed in a front surface of the second door 740.

In the present embodiment, a water supply passage 292 for supplying the water into an ice maker 452 and the dispenser 746 is directly connected to a water supply source. When the first door 730 and/or the second door 740 are/is withdrawn, the water supply passage 292 is separated at any position, and the water supply is stopped by an opening/closing valve V disposed at the separated position.

A partition or a frame may be not provided between a lower end of the first door 730 and an upper end of the second door 740, and a pillar 50 may be pivotably disposed on a back surface of the lower end of the first door 730. A structure and operation of the pillar 50 will be described below in detail with reference to accompanying drawings.

A discharge duct 462 for guiding a withdrawal of ice is disposed at a front side of a bottom surface of the ice making assembly 450 and extends toward the dispenser 740. In detail, an ice chute 748 for guiding the withdrawal of the ice is disposed at an upper side of the dispenser 740. An end portion of the discharge duct 462 extends near to an inlet port of the ice chute 748.

The discharge duct 462 does not extend below an upper end of the second door 740. That is, an end portion of the discharge duct 462 may maximally extend up to a plane L1 horizontally parallel to the upper end of the second door 740. This is done because it prevents the discharge duct 462 form interfering with the second door 740 when the first door 730 is opened in a state where the second door 740 is closed.

The inlet port of the ice chute 748 protrudes toward the discharge duct 462. However, the inlet port does not extend above a plane L2 horizontally parallel to a lower end of pillar 50. That is, this is done because it prevents the inlet port of the ice chute 748 from interfering with the pillar 50 when the second door 740 is opened in a state where the first door 730 is closed.

Dampers D may be disposed inside the discharge duct 462 and the ice chute 748, respectively, to prevent the ice from being dispensed when any one of the first door 730 and the second door 740 is opened.

As a result, the end portion of the discharge duct 462 is not closely attached to the inlet port of the ice chute 748. Thus, the dampers D may be manipulated to prevent cool air supplied into an ice maker 460 from leaking into the second storage room 720 or the dispenser 746. For this, a passage formed by the discharge duct 462 and the ice chute 748 is covered by the dampers D, except when the ice is dispensed.

The end portion of the discharge duct 462 has an inside diameter d1 equal to or less than that of the inlet port of the ice chute 748 to prevent a portion of the ice from being introduced into the second storage room 720.

Referring to FIG. 21, a rail member 60 may be disposed on both lateral surfaces of the receiving part 734. The rail member may 60 be withdrawn in multi-step. That is, the rail member 60 include fixed rails 61 respectively fixed to the both lateral surfaces of the receiving part 734 and a movement rail 62 movably connected to the fixed rails 61. A support structure for slidingly supporting the rail member 60 may be disposed on an inner sidewall of the second storage room 720. The rail member 60 has the same structure as or is similar to a rail member that will be described in detail in the following embodiment.

Figure 24:
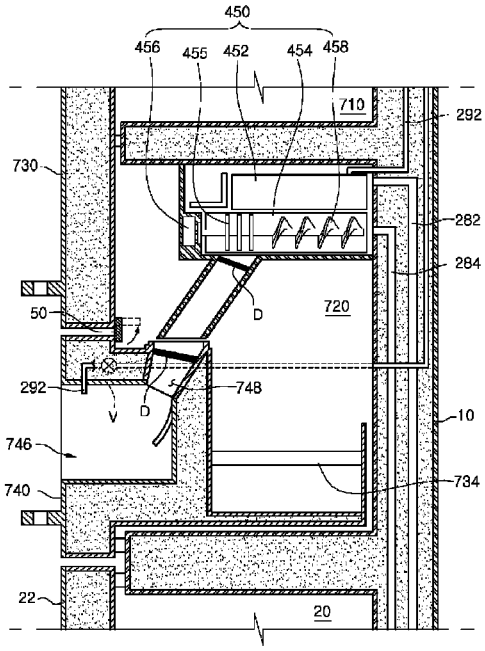
FIG. 24 is a side cross-sectional view of a refrigerator according to another embodiment.

FIG. 24 is a side cross-sectional view of a refrigerator according to another embodiment.

Referring to FIG. 24, a refrigerator according to the present embodiment has the same structure as that shown in FIG. 21, except that an ice making compartment 460 is fixed inside a storage room.

As shown in FIG. 24, the ice making compartment 460 is fixed to a rear surface of a second storage room 720, and an ice making assembly 450 is received into the ice making compartment 460. Thus, a portion of an upper side of the first door 730 covers the whole of the first storage room 710, and a portion of a lower side of the first door 730 covers a portion of the second storage room 720. A dispenser 746 is disposed on a back surface of the second door 740, and the second door 740 covers the remaining portion of the second storage room 720.

A discharge duct 462 extends from a bottom surface of the ice making compartment 460, and an end portion of the discharge duct 462 extends toward an ice chute 748 disposed above the dispenser 746. That is to say, the discharge duct 462 may inclinedly extend in a front direction up to an inlet port of the ice chute 748. This is done because the ice making compartment 460 is not moved even if the first door 730 is withdrawn forwardly, and because it does not matter that the end portion of the discharge duct 462 extends up to a position lower than that of an upper end of the second door 740. This is different from the embodiment of FIG. 21. Thus, since a distance between a lower end of the discharge duct 462 and an inlet of the ice chute 748 may be minimized, leakage of cool air may be minimized. Of course, in case of the present embodiment, dampers D may be disposed inside the discharge duct 462 and the ice chute 748, respectively.

Figure 25:
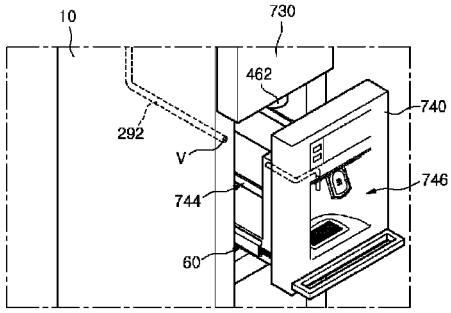
FIGS. 25 and 26 are partial perspective views of a power supply structure connected to a water supply passage and a dispenser provided in a refrigerator according to an embodiment.
Figure 26:
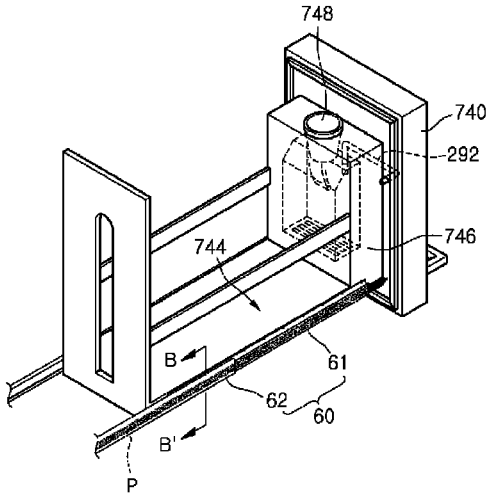
Figure 27:
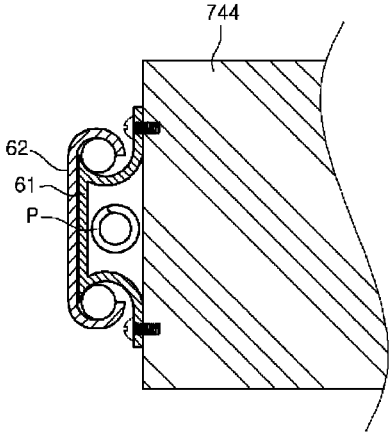
FIG. 27 is a cross-sectional view taken along line B-B of FIG. 26.

FIGS. 25 and 26 are partial perspective views of a power supply structure connected to a water supply passage and a dispenser provided in a refrigerator according to an embodiment, and FIG. 27 is a cross-sectional view taken along line B-B of FIG. 26.

A water supply passage and a wire shown in FIGS. 25 to 27 may be commonly applicable to all of the previously described embodiments and the following embodiments. It is to be understood that the water supply passage is merely illustrative of one of various embodiments. A structure of a refrigerator, based on the structure of the refrigerator shown in FIG. 21, will be described below.

Referring to FIG. 25, a water supply passage 292 extending from a water tank or a water supply source extends along a sidewall of a refrigerator body 10. The water supply passage 292 extends up to a front surface of the sidewall of the refrigerator body 10, and an opening/closing valve V is disposed at an end portion of the water supply passage 292.

Referring to FIG. 26, a water supply passage 292 for dispensing drinking water within a second door 740 extends toward a dispenser. An end portion of the water supply passage 292 protrudes from an edge portion of a back surface of the second door 740. The end portion of the water supply passage 292 is selectively coupled to the opening/closing valve V. That is, when the second door is completely closed, the water supply passage of the refrigerator body 10 and the water supply passage of the second door 740 are connected to each other, and the opening/closing valve V is opened.

Although only the water supply passage for dispensing the drinking water extends along the refrigerator body in the present embodiment, the present disclosure is not limited thereto. For example, when an ice making compartment is fixed to the first door or the second door, a water supply passage for making ice may be realized also using the same manner.

As described above, rail members 60 are disposed on both lateral surfaces of a portion corresponding to a bottom surface of a receiving part 734. A wire P extends inside one rail member 60 and is connected to a controller (not shown) for operating a display or dispenser disposed in the second door 740.

Referring to FIG. 27, the wire P extends inside a fixed rail 61 fixed to a lateral surface of the receiving part 734. The wire P may be wound in a spiral shape and have a predetermined elasticity. Thus, the wire P may extend according to forward and backward movements of the second door 740, and then, returns to prevent the wire from being damaged.

Figure 28:
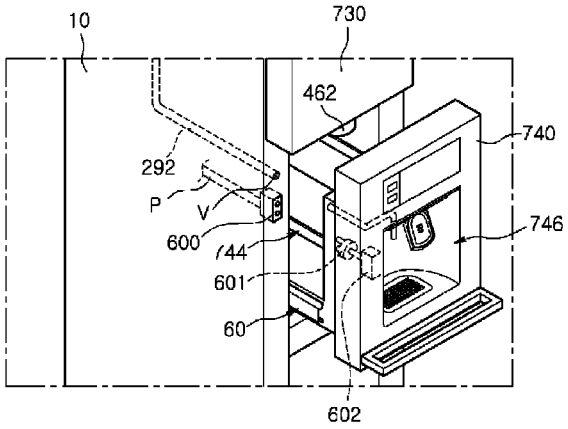
FIGS. 28 and 29 are partial perspective views of a power supply structure connected to a dispenser of a refrigerator according to another embodiment.
Figure 29:
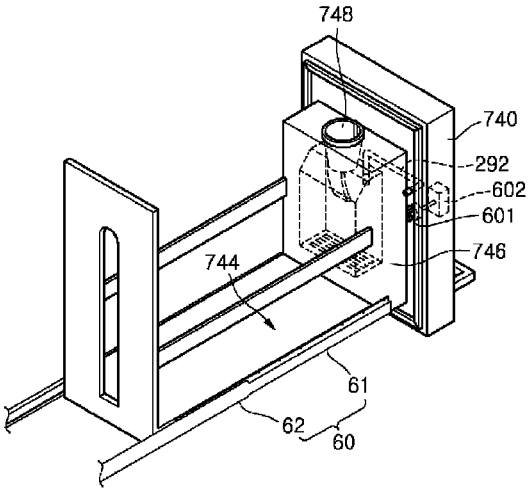

FIGS. 28 and 29 are partial perspective views of a power supply structure connected to a dispenser of a refrigerator according to another embodiment.

Referring to FIGS. 28 and 29, a refrigerator according to the present embodiment has the same structure as that shown in FIGS. 25 and 26, except for a power supply structure. Thus, duplicated descriptions of other components except for the power supply structure will be omitted.

In detail, in the present embodiment, a wire P extends along an inner sidewall of a refrigerator body 10. A socket 600 may be disposed on a front surface of the sidewall of the refrigerator body 10, i.e., a surface in contact with a back surface of a first door 730 or a second door 740. The wire P is connected to the socket 600.

A plug 601 may protrude from a surface corresponding to the socket 600 of the back surface of the second door 740 (or the first door 730). A battery 602 for an electric charging may be laid inside the second door 740 and be connected to the plug 601. The battery 602 is electrically connected to a controller for controlling operations of a display attached to a front surface of the second door 740 and other electric components. It is obvious that the plug 601 may be disposed on the refrigerator body 10, and the socket 600 may be disposed on the second door 740.

When the second door 740 is completely closed, the plug 601 is inserted into the socket 600. Thus, current flows to charge the battery 602. When the second door 740 is withdrawn forwardly, the plug 601 is separated from the socket 600 to stop the charging.

When the second door 740 is completely closed, a variety of electric components including the display disposed on the second door 740 is operated by the current supplied through the wire p. On the other hand, when the second door 740 is opened, the display and other electric components are operated by the current supplied from the battery 602.

Figure 30:
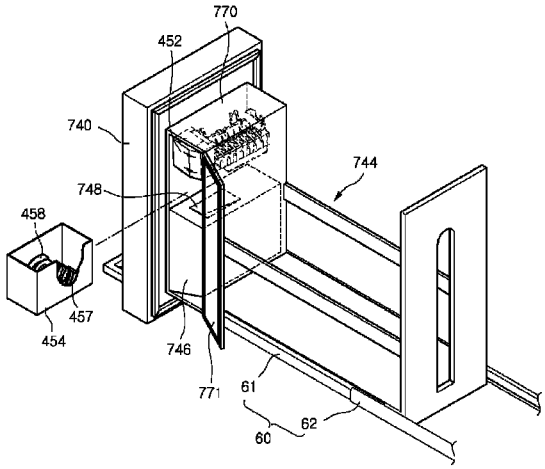
FIGS. 30 and 31 are partial perspective views of a refrigerator according to another embodiment.
Figure 31:
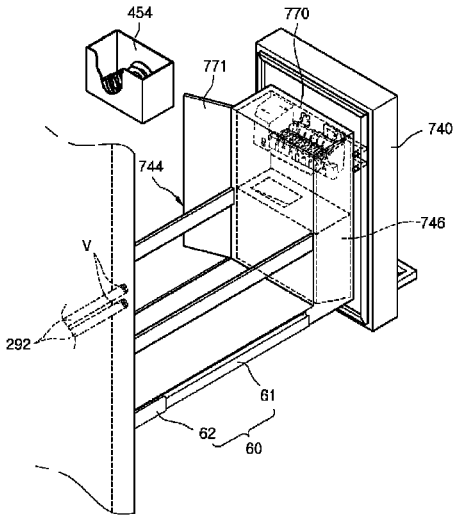

FIGS. 30 and 31 are partial perspective views of a refrigerator according to another embodiment.

Referring to FIGS. 30 and 31, in the present embodiment, an ice making compartment is defined on a back surface of a storage compartment door, and an ice making assembly and a dispenser are received into the ice making compartment. A structure in which a water supply passage for making ice and a water supply passage for dispensing drinking water extend toward a door will be described in detail.

For easy understanding of description, a structure according to the present embodiment, realized on a back surface of a second door 740 for opening and closing a second storage room, will be described below.

In detail, an ice making compartment 770 is vertically disposed on a back surface of the second door 740. An ice making compartment door 771 is pivotably disposed on a side of the ice making compartment 770.

An ice maker 452 and an ice bank 454 constituting an ice making assembly 450 are received into the ice making compartment 770. An auger 458 and a crusher 457 are provided inside the ice bank 454. An electric motor (not shown) for operating the auger 458 and the crusher 457 may be laid inside the second door 740. In detail, the ice maker 452 may be disposed on an inner top surface of the ice making compartment 770, and the ice bank 454 may be detachably disposed direct below the ice maker 452. A dispenser 746 including an ice chute 748 is disposed at a lower side of the ice bank 454. That is, the ice bank 454 may be detachably disposed on a top surface of the dispenser 748. The ice bank 454 may be slidingly movable laterally from the top surface of the dispenser 748. Thus, a user may open the ice making compartment door 771 to easily separate the ice bank 454 from a refrigerator in a state where the second door 740 is withdrawn.

Although a transfer unit including the auger 458 and the crusher 457 extends forwardly and backwardly in the present embodiment, the present disclosure is not limited thereto. For example, a vertical auger structure disclosed in U.S. Pat. No. 6,082,103 may be applicable to the present embodiment. Also, an auger structure, in which a rotation axis is inclined, disclosed in Korean Published Applications No. 2008-0053503 may be applicable to the present embodiment. Here, the rotation axis may extend in a direction crossing the second door 740 and may be inclined in up and down or left and right directions. Or, the rotation axis may extend in a direction parallel to the second door 740 and may be inclined in a vertical direction.

A pair of water supply passages 292 within sidewalls of a second storage room 720 opened and closed by the second door 740 may extend in a front direction, and opening/closing valves V may be disposed at front ends of the water supply passages 292. End portions of the water supply passages selectively coupled to the opening/closing valves V may protrude from an edge portion of a back surface of the second door 740. Since structures of the water supply passages ware previously described, duplicated descriptions thereof will be omitted.

A receiving part 744 may be disposed at a rear side of the ice making compartment 770, and rail members may be disposed on both lateral surfaces of the receiving part 744 to allow the second door 740 to be withdrawn forwardly.

Figure 32:
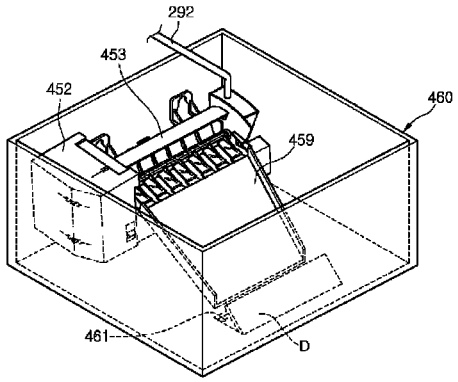
FIG. 32 is a perspective view illustrating a structure of an ice-making assembly of a refrigerator according to an embodiment.

FIG. 32 is a perspective view illustrating a structure of an ice-making assembly of a refrigerator according to an embodiment.

Referring to FIG. 32, an overflow prevention unit is illustrated in the present embodiment. The overflow prevention unit prevents water supplied into an ice making assembly from overflowing due to an inertial force generated when a storage room door is moved forwardly and backwardly.

In detail, an ice maker 452 is disposed horizontally or vertically inside an ice making compartment 460. A water supply passage 292 extends in a direction crossing the ice making compartment 460 toward the ice maker 452.

A discharge hole 461 is defined in a bottom surface of the ice making compartment 460. Also, a guide member is disposed to transfer ice separated from the ice maker 452 toward the discharge hole 461. The guide member may include a guide plate 459 extending from a lateral surface of the ice maker 452. In detail, the guide plate 459 inclinedly extends downwardly from a lateral end of a top surface of the ice maker 452 to approach to the discharge hole 461.

An overflow prevention part 453 may extend from an edge portion of the top surface of the ice maker 452. In detail, in case where the ice making compartment 460 is disposed on a storage room door, water stored in the ice maker 452 may overflow due to inertia when the storage room door is moved forwardly and backwardly. The overflow prevention part 453 may be provided to prevent the water from overflowing. The overflow prevention part 453 may have a structure in which water overflowing by the inertia returns again to the ice maker 452. That is, the overflow prevention part 453 may extend in a direction crossing an inertia direction, and an upper portion thereof may be rounded. Thus, the water soars upwardly from the ice maker 452 flows along an inner surface of the overflow prevention part 453 to return again to the ice maker 452. The overflow prevention part 453 may have various shapes according to an internal structure of the ice making compartment 460 and an installation direction of the ice maker 452. Alternatively, a residual water tray for receiving the overflowing water may be disposed on a bottom surface of the ice maker 452.

In the present disclosure, the ice making assembly may be defined as an ice making mechanism, as well as, a structure including the ice making assembly and the ice making compartment may be inclusively defined also as the ice making mechanism. That is, a structure including at least ice making assembly may be defined s the ice making mechanism. It may be widely construed that the ice making compartment denotes a physical configuration such as an insulation wall structure surrounding the ice making assembly as well as an inner space defined by the insulation wall structure.

Also, the storage room disclosed in the present disclosure, i.e., the first storage room and the second storage room may be used as one of the refrigerator compartment and the freezer compartment. In addition, the storage room may be used as the switching room in which the refrigerator compartment and the freezer compartment may be mutually converted according to a user s selection or a driving condition.

In a structure of the refrigerator according to the previously described embodiments, the slidable door that is movable in forward and backward directions, but the pivotable door, is provided at a side of the refrigerator door. Thus, when the refrigerator is installed at an edge portion of an indoor space, a door closely attached to a wall is not rotated at an angle greater than about 90 degrees. However, the prevent disclosure may overcome such a limitation.

Also, the storage room disclosed in the present disclosure has a width relatively narrower than the refrigerator compartment. However, since long containers such as a bottle may be easily received into the storage room, space utilization of the inside of the refrigerator may be improved.

Figure 33:
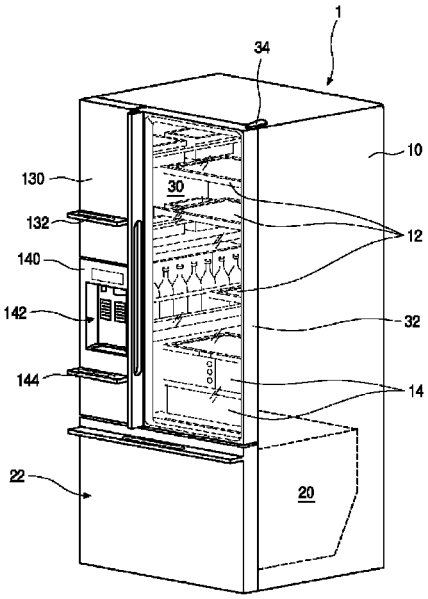
FIG. 33 is a perspective view illustrating an outer appearance of a refrigerator according to an embodiment.
Figure 34:
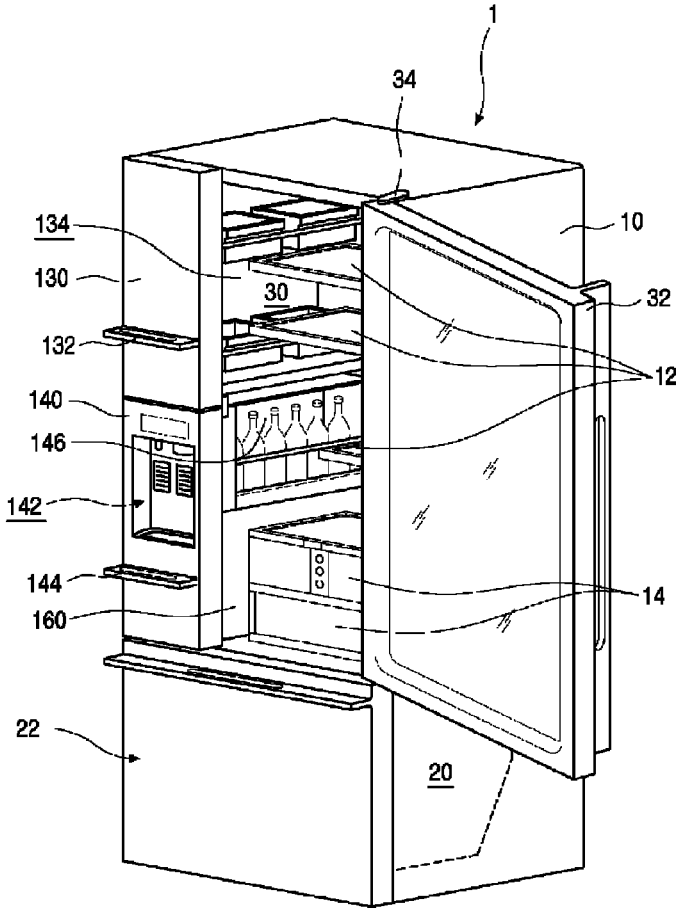
FIG. 34 is a perspective view of a refrigerator when a refrigerator door is opened, according to an embodiment.

FIG. 33 is a perspective view illustrating an outer appearance of a refrigerator according to an embodiment, and FIG. 34 is a perspective view of a refrigerator when a refrigerator door is opened, according to an embodiment.

Referring to FIGS. 33 and 34, a refrigerator of the present embodiment is almost similar to those of FIGS. 1 and 2. However, a separate barrier for partitioning the inside of the refrigerator is not provided, and a refrigerator door for opening and closing a refrigerator compartment defined in one space includes a pivotable door and a plurality of slidable doors.

In detail, a refrigerator according to the present embodiment includes a body 10 in which a refrigerator compartment 30 and a freezer compartment are defined, a refrigerator compartment door 32, a freezer compartment door 22, a first door 130, and a second door 140. The refrigerator compartment 30 and the freezer compartment are selectively covered by the refrigerator compartment door 32, the freezer compartment door 22, the first door 130, and the second door 140, respectively. Also, an outer appearance of the refrigerator is defined by the doors.

The refrigerator compartment 30 and the freezer compartment 20 are defined at upper and lower portions of the body 10, respectively. The refrigerator compartment 30 is covered by the refrigerator compartment door 32, the first door 130, and the second door 140. The freezer compartment 20 is covered by the freezer compartment door 22.

In detail, the refrigerator compartment door 32 covers a portion of an opened front surface of the refrigerator compartment 30 and is pivotably disposed on a body 10. For this, the refrigerator compartment door 32 is coupled to the body 10 by a hinge 34.

A vertical length of the refrigerator compartment door 32 corresponds to a vertical length of the refrigerator compartment 30. Also, the refrigerator compartment door 32 has a width less than that of the refrigerator compartment 30. Thus, the refrigerator door 32 may covers a remaining portion, exclusive of a predetermined horizontal width of the refrigerator compartment 30, by a rotation thereof.

At least portion of the refrigerator compartment door 32 may be formed of a transparent or translucent glass material to enable the refrigerator compartment 30 to be viewed through the refrigerator compartment door 32. Specifically, even foods received in a first door 130 and a second door 140 that will be described below may be viewed through the refrigerator compartment door 32 from the outside.

A front surface of the refrigerator door 32 may be formed of a glass material, and a circumference thereof may be formed of a plastic or metallic material. Data inputted form the outside may be displayed through the glass of the refrigerator compartment door 32, and operation information of the refrigerator 1 may be also displayed.

A front surface of the refrigerator compartment 30, which is not covered by the refrigerator compartment door 32, may be covered by the first door 130 and the second door 140, respectively. An opened front surface of the refrigerator compartment 30 may be covered by the refrigerator compartment door 32 and another door, or may be covered by two or more doors.

A plurality of shelves 12 and drawers 14 is provided inside the refrigerator compartment 30 to store foods. The shelves 12 and drawers 14 are disposed at a rear side of the refrigerator door 32 and have horizontal widths less than that of the refrigerator compartment door 32. Thus, when only the refrigerator compartment door 32 is opened, each of the drawers 14 and shelves 12 may be withdrawable without interfering.

The shelf 12 is detachably disposed in a cantilever manner on an inner rear surface of the refrigerator compartment 30. Also, the shelf 12 may be detached at an inner space of the refrigerator compartment 30 to adjust a height thereof.

The first door 130 and the second door 140 are disposed at a left side of the refrigerator compartment door 32 to cover a left space of the refrigerator compartment 30. The first door 130 may be disposed above the second door 140.

The first door 130 and the second door 140 may be withdrawable in a drawer-type. Door handles 132 and 144 may be disposed on front surfaces of the first door 130 and the second door 140. Receiving parts (reference numerals 134 and 146 of FIG. 3) for receiving foods may be disposed at a rear side of the first door 130 and the second door 140. An ice making compartment (reference numeral 160 of FIG. 3) for making and storing ice is disposed at the rear side of the second door 140.

A dispenser 142 for dispensing drinking water and the ice at the outside is disposed in a front surface of the second door 140. The dispenser 142 communicates with the ice making compartment 160 to dispense the ice stored in the ice making compartment 160 at the outside and is connected to an external water supply source by a water supply passage to dispense the drinking water.

Dispensing holes for respectively dispensing the made ice and the drinking water and a manipulation unit may be disposed in the dispenser 142. A residual water tray for receiving residual water generated when the ice or the drinking water is dispensed may be disposed below the dispenser 142. A display for illustrating an operation state of the refrigerator may be disposed above the dispenser 142.

Figure 35:
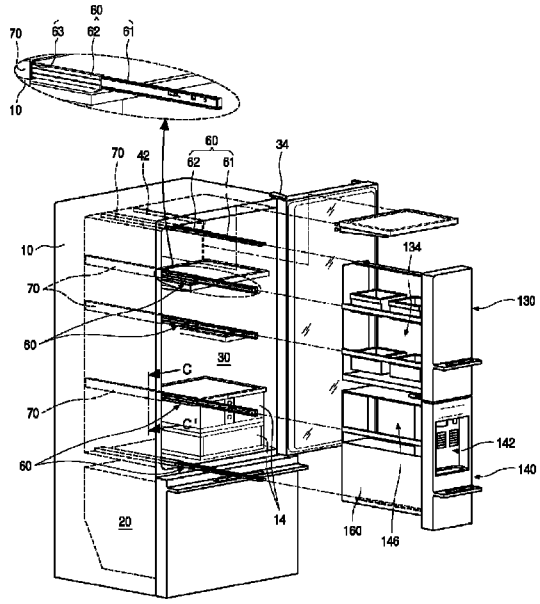
FIG. 35 is an exploded perspective view of a refrigerator when a first door and a second door are withdrawn, according to an embodiment.
Figure 36:
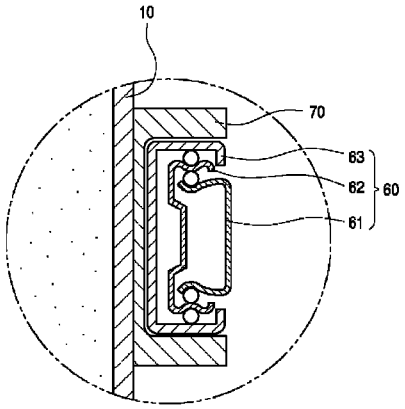
FIG. 36 is a cross-sectional view taken along line C-C of FIG. 35 when the first door is closed.

FIG. 35 is an exploded perspective view of a refrigerator when a first door and a second door are withdrawn, according to an embodiment, and FIG. 36 is a cross-sectional view taken along line C-C of FIG. 35 when the first door is closed.

Referring to FIGS. 35 and 36, a first door 130 and a second door 140 may be withdrawn forwardly and backwardly by a rail member 60 inside a body 10.

The rail member 60 includes a mounting rail 63 mounted on a rail mounting member 70 disposed on the body 10, a movement rail 62 slidingly moved inside the mounting rail 63, and a fixed rail 61 disposed on the first door 130 or the second door 140, slidingly moved along the movement rail 62, and connected to a slidable door.

The rail member 60 may extend in multi-step so that the rail member 60 has sufficient length to completely withdraw receiving parts 134 and 146 disposed on the first door 130 and the second door 140 to the outside when the first door 130 and the second door 140 are withdrawn.

Thus, the first door 130 and the second door 140 may be slidingly withdrawn forward and backward by the rail member 60, and thus, it is possible that a portion of the refrigerator compartment 30 is opened to expose the receiving parts 134 and 146 to the outside.

The rail member 60 may be disposed on another side of an upper side and/or a lower side and left and right sides of the first door 130 and the second door 140, except for a side of left and right sides of the first door 130 and the second door 140.

In detail, the rail mounting member 70 may be disposed on an inner sidewall of the refrigerator compartment 30 adjacent to the first door 130. The rail mounting member 70 is disposed to support and mount the rail member 60. The rail mounting members 70 may be disposed in front and rear directions and at positions corresponding to a top surface and left side surface of the first door 130, respectively.

One or more rail mounting members 70 disposed on an inner sidewall of the refrigerator compartment 30 corresponding to the left side surface of the first door 130 may be provided according to a vertical length of the first door 130.

The movement rail 62 is fixed to the mounting rail 63 mounted on the rail mounting member 70. The fixed rail 61 is fixed to a top surface and left and right surfaces of the first door 130. The mounting rail 63, the movement rail 62, and the fixed rail 61 may be slidingly movable in a length direction. Thus, the first door 130 may be withdrawn in a state where the first door 130 is hanged on inner upper and left sides of the refrigerator compartment 30.

The rail mounting member 70 may be disposed also inside the refrigerator compartment 30 adjacent to the second door 140. The rail member 60 and the rail mounting member 70 have the same structure as those of the first door 130, except for installation positions thereof, and thus, will be given by the same reference numerals.

In detail, the rail mounting member 70 is disposed on an inner bottom surface of the refrigerator compartment 30 corresponding to a bottom surface of the second door 140 and inner left and right side surfaces of the refrigerator compartment 30 corresponding to the left and right side surfaces of the second door 140.

The mounting rail 63 of the rail member 60 is mounted on the rail mounting member 70. The movement rail 62 is mounted on the mounting rail 63. The fixed rail 61 is mounted on a left side surface and a bottom surface of the second door 140. Thus, the second door 140 may be withdrawn in a state where the second door 140 is supported by the bottom surface and the left side surface of the refrigerator compartment 30.

The rail mounting member 70 and the rail member 60 are disposed on the inner sidewall of the refrigerator compartment 30. However, when a separate storage space, such as the drawer 14 or the storage room (reference numeral 102 of FIG. 41), adjacent to the slidable door is provided, the rail mounting member 70 and the rail member 60 may be disposed at corresponding positions to assist the withdrawal of the slidable door.

A withdrawal guide 42 vertically protruding from an inner top surface and/or an inner bottom surface of the refrigerator compartment 30 may be disposed to prevent the door from being shaken during the withdrawal of the door. The withdrawal guide 42 protrudes to contact with a lateral surface of the slidable door. That is, the withdrawal guide 42 is in contact with a lateral upper end or lower end of the slidable door. In addition, the withdrawal guide 42 may be disposed in front and rear directions to stably guide the slidable door during the withdrawal of the slidable door.

If necessary, the rail mounting member 70 and the rail member 60 may be disposed on the withdrawal guide 42. The withdrawal guide 42 may be disposed without covering foods received in the slidable door.

An ice making compartment 160 for making and storing ice is disposed at a lower side of a back surface of the second door 140. The ice making compartment 160 communicates with the dispenser 142. If necessary, an additional rail member 60 for guiding the withdrawal of the second door 140 may be further provided between a left side surface of the ice making compartment 160 and a right side surface of the drawer 14, which are adjacent to each other.

The ice making compartment 160 may be disposed at an upper or lower portion of the second door 140. Thus, the receiving part 146 may be disposed also at the upper or lower portion of the second door 140.

Figure 37:
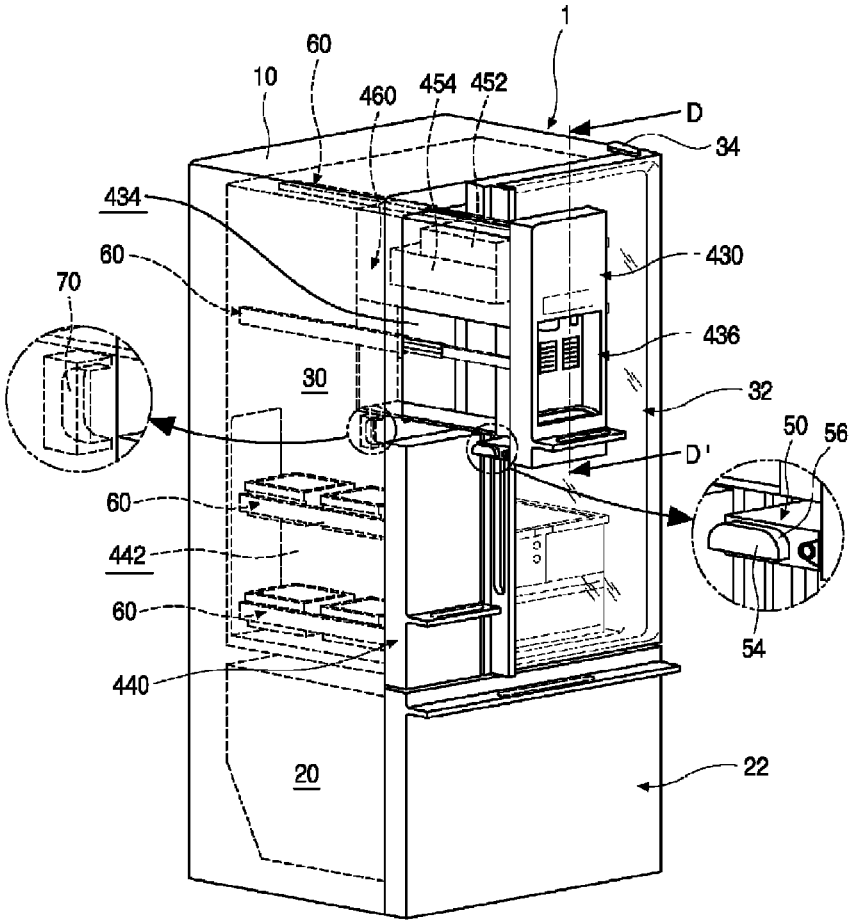
FIG. 37 is a perspective view of a refrigerator when a first door is opened, according to another embodiment.
Figure 38:
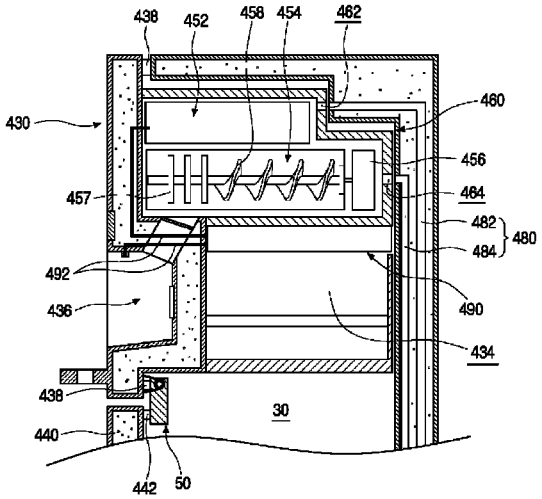
FIG. 38 is a cross-sectional view taken along line C-C of FIG. 37 when the first door is closed.
Figure 39:
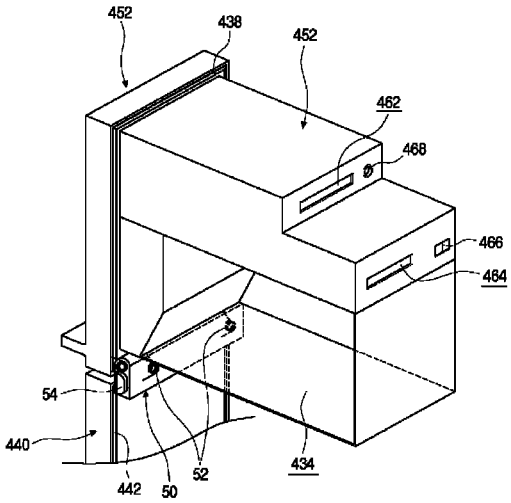
FIG. 39 is a bottom perspective view of a first door according to another embodiment.

FIG. 37 is a perspective view of a refrigerator when a first door is opened, according to another embodiment, FIG. 38 is a cross-sectional view taken along line C-C of FIG. 37 when the first door is closed, and FIG. 39 is a bottom perspective view of a first door according to another embodiment.

Referring to FIGS. 36 to 39, a refrigerator of the present embodiment has the same structure as that of FIG. 8, except that a separate barrier for partitioning the inside of the refrigerator is not provided, the refrigerator defined as one space is covered by a refrigerator compartment door, a first door, and a second door, and a pillar is disposed between the first door and the second door.

In detail, a body 10 is vertically partitioned into a refrigerator compartment 30 and a freezer compartment 20. A portion of the refrigerator compartment 30 is covered by a refrigerator door 32, and another portion of the refrigerator compartment 30 is covered by a first door 430 and a second door 440.

The refrigerator compartment door 32 is coupled to the body 10 using a hinge 34, and thus is pivotally opened and closed. A portion of a front surface of the refrigerator compartment door 32 may be transparent to enable the refrigerator compartment 30 to be viewed through the refrigerator compartment door 32. The first door 430 and the second door 440 may be vertically disposed at a side of the refrigerator compartment door 32. The first door 430 and the second door 440 may be disposed inside the refrigerator compartment 30 and slidingly withdrawn by a rail member 60.

The rail member 60 for withdrawing the first door 430 is disposed on inner upper and left side surfaces of the refrigerator compartment 30 to support and slidingly move the first door 430. The rail member 60 for withdrawing the second door 440 is disposed on inner lower and left side surfaces of the refrigerator compartment 30 to support and slidingly move the first door 430.

Receiving parts 434 and 442 for receiving foods are disposed on the first door 430 and the second door 440. A dispenser 436 for dispensing water and ice is disposed in a front surface of the first door 430. Considering a height of a user, the dispenser 436 may be disposed at a lower side of the first door 430.

An ice making compartment 460 is disposed at an upper side of the first door 430. An ice maker 452 and an ice bank 454 are received into the ice making compartment 460. The ice making compartment 460 may be formed with an independent insulation space within the refrigerator compartment 30.

The ice making compartment 460 may be detachably coupled to a back surface of the first door 430 and may be integrally formed by a door liner defining the back surface of the first door 430.

The ice making compartment 460 may extend from the back surface of the first door 430 toward a rear direction, and thus may be adjacent to a rear surface of the refrigerator compartment 30. Also, when the first door 430 is completely inserted, a cool air duct 480 disposed inside the body 10 communicates with the inside of the ice making compartment 460.

In detail, the cool air duct 480 includes a supply duct for guiding cool air into the ice making compartment 460 and a return duct for guiding the cool air toward an evaporator. A cool air inlet 462 and a cool air outlet 464 are defined in a rear wall of the ice making compartment corresponding to the supply duct 482 and the return duct 484, respectively.

Thus, when the first door 430 is completely inserted, the supply duct 484 may communicate with the cool air inlet 462, and the return duct 484 may communicate with the cool air outlet 464 to continuously circulate the cool air between the ice making compartment 460 and the evaporator.

An auger 458 operated by an electric motor 456 and a crusher 457 disposed on the same rotation axis to crush the ice are disposed in the ice bank 454 within the ice making compartment 460. A power source for operating the electric motor 456 of the ice bank 454 and the ice maker 452 may be inputted by a power connector connected to the electric motor 456 and the ice maker 452 when the first door 430 is completely inserted.

A water tank 490 for supplying the water into the ice maker 452 and the dispenser 436 is disposed at a side of the ice making compartment 460. The water tank 490 may be detachably disposed, and thus filled with a desired amount of the water by a user. Thus, when the first door 430 is withdrawn, the ice making compartment 460 and the water tank 490 may be withdrawn together with the first door 430 in front and rear directions.

The water stored in the water tank 490 may be supplied into the dispenser 436 and the ice maker 452 through a water supply passage 492. The water supply passage 492 connects the water tank 490 to the dispenser 436 and the ice maker 452. At least portion of the water supply passage 492 may be buried inside insulation foam filled inside the first door 430.

The water tank 490 may be disposed in the body 10 spaced from the ice making compartment 460. The water tank 490 may be connected to a water supply passage directly connected to the ice maker 452 and the dispenser 436. At this time, the water supply passage may be selectively connected to a connection part 468 disposed at a side of the ice making compartment 460. A valve may be disposed in the water supply passage.

Gaskets 438 for preventing the cool within the refrigerator compartment 30 air from leaking are disposed on back surfaces of the first door 430 and the second door 440. A pillar 50 is disposed at a position adjacent between the first door 430 and the second door 440.

The pillar 50 covers a space between the first door 430 and the second door 440. The pillar 50 is disposed at a lower end of the back surface of the first door 430. The pillar 50 is selectively pivoted according to the withdrawal of the first door 430 to selectively cover the space between the first door 430 and the second door 440.

In detail, the pillar 50 has a length corresponding to a horizontal width of the first door 430. When the first door 430 is inserted, the pillar is pivoted. As a result, a lower end of the first door 430 and an upper end of the second door 440 are in contact with a front surface of the pillar 50 to prevent the cool air within the refrigerator compartment 30 from leaking between the first door 430 and the second door 440.

The pillar 50 is hinge-coupled to the lower end of the first door 430. The pillar 50 is closely attached to the first door 430 by an elastic member 52 in a state where the front surface of the pillar 50 is inclined downwardly when an external force is not applied to the elastic member 52. The pillar 50 may be covered by a front surface of the first door 430. Thus, the pillar 50 may be not exposed to the outside when viewed from a front direction of the first door 430.

The elastic member 52 disposed in the pillar 50 may have a coil spring shape. The elastic member 52 may connect the pillar 50 to a side of the first door 430. The pillar 50 may be closely attached the lower end of the first door 430 due to elasticity of the elastic member 52 if the external force is not applied to the pillar 50.

The elastic member 52 may have various shapes except for the coil spring shape. Also, the elastic member 52 may be disposed at various positions to provide an elastic force to the pillar 50.

A guide protrusion 54 protruding outwardly is disposed at one end of the pillar 50. The guide protrusion 54 may moved along a guide groove 70 defined in a lateral surface corresponding to the inside of the refrigerator compartment 30. Surfaces of the guide groove 70 and the guide protrusion 54, which correspond to each other, may be rounded with a predetermined curvature to smoothly rotate the pillar 50.

In detail, the guide groove 70 is opened in a front direction and is depressed inwardly. The guide groove 70 is curved inwardly with a predetermined curvature. A curved part 56 corresponding to the curvature of the guide groove 70 is disposed on the guide protrusion 54 contacting with the guide groove 70. Thus, when the guide protrusion 54 of the axially coupled pillar 50 is moved along the guide groove 70 fixed to an inner wall of the refrigerator compartment 30, the pillar may be rotatable.

Figure 40:
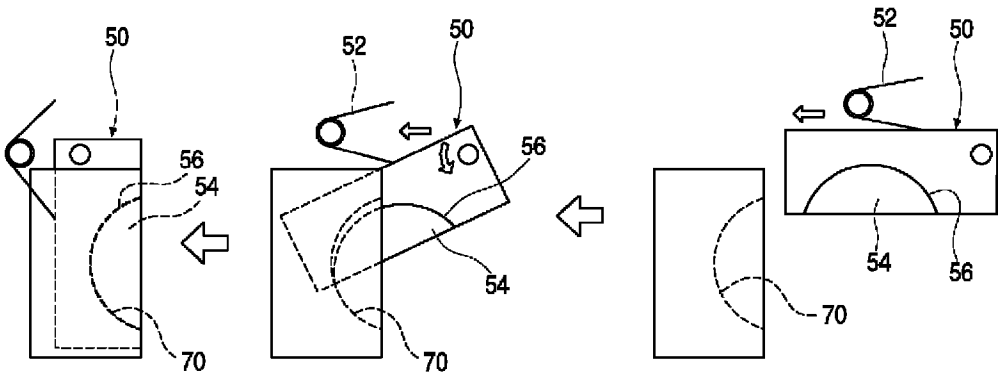
FIG. 40 is a view illustrating successive operations of a feeler according to another embodiment.

FIG. 40 is a view illustrating successive operations of a feeler according to another embodiment.

Referring to FIGS. 37 and 40, when the first door 430 is opened, the front surface of the pillar 50 is inclined downwardly due to an elastic restitution force applied by the elastic member 52.

When the first door 430 is inserted in a rear direction, the curved part 56 of the guide protrusion 54 contacts with the guide groove 70. When the first door 430 is further inserted, the pillar 50 is moved backwardly along the first door 430 to rotate about a rotation axis in a count-clockwise direction. At this time, the curved part 56 disposed on the guide protrusion 54 is slidingly moved along an inner surface of the guide groove 70.

When the first door 430 is completely inserted, the curved part 56 of the guide protrusion 54 is completely rotated along the guide groove 70. At this time, the front surface of the pillar 50 is faced in a front direction and is in contact with the lower end of the first door 430 and the upper end of the second door 440.

The curved part 56 of the pillar 50 is coupled to the inside to the guide groove 70. The front surface of the pillar 50 is rotated by 90 degrees in a count-clockwise direction when compared to a state in which the first door 430 is opened and is faced in a front direction of the refrigerator 1.

In this state, the elastic member 52 completely extends. When the first door 430 is withdrawn again, the pillar 50 is rotated in a clockwise direction due to the elastic restitution force of the elastic member 52. At this time, the curved part 56 of the pillar 50 is slidingly moved along the guide groove 70.

Figure 41:
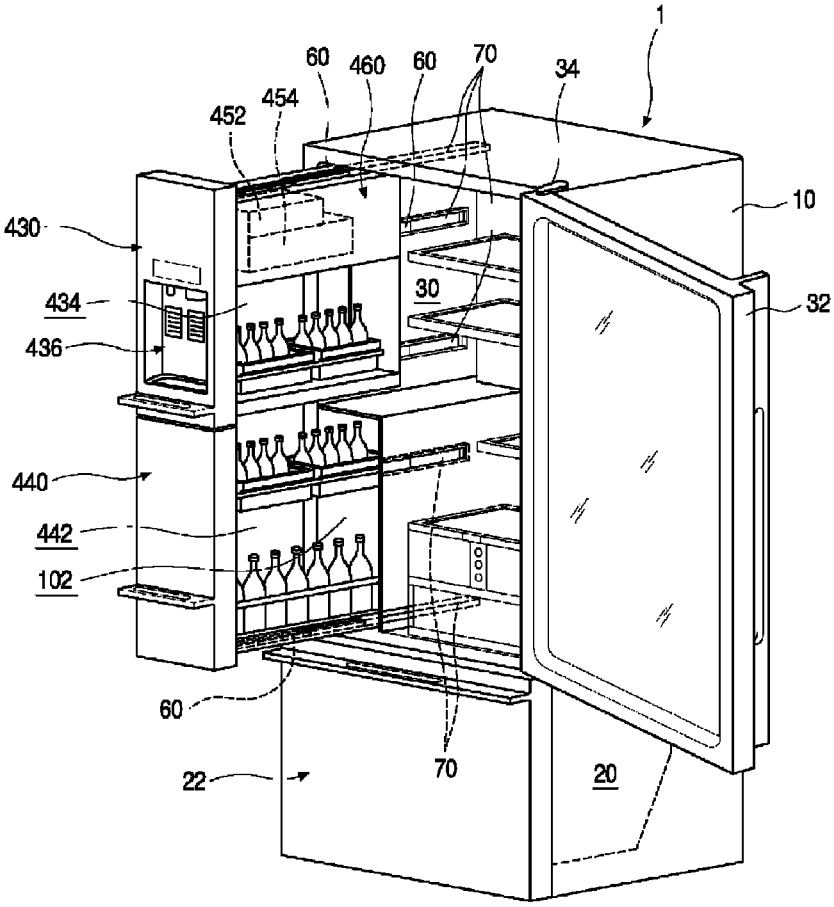
FIG. 41 is a perspective view of a refrigerator when a door is opened, according to another embodiment.

FIG. 41 is a perspective view of a refrigerator when a door is opened, according to another embodiment.

Referring to FIG. 41, a refrigerator of the present embodiment has the same structure as that of FIG. 37, except that a separate storage room is defined at a side of the refrigerator compartment. Thus, duplicated descriptions with respect to other configurations except for a configuration of an inner space of the refrigerator compartment will be omitted.

In detail, a body 10 of the present embodiment is vertically partitioned into a refrigerator compartment 30 and a freezer compartment 20. The refrigerator compartment 30 is selectively covered by a refrigerator compartment door 32 and a first door 430. The freezer compartment 20 is selectively covered by a freezer compartment door 22. At this time, an opened front surface of the body 10 corresponding to a refrigerator compartment region is selectively covered by the refrigerator compartment door 32, the first door 430, and the second door 430.

In detail, the refrigerator door 32 is coupled to the body 10 using a hinge 34 to cover a right side portion of the opened front surface of the refrigerator compartment 30 by a rotation thereof. Also, the first door 430 including a receiving part 434 may be withdrawn forwardly and backwardly in a drawer-type to cover an upper portion of the remaining left side portion of the refrigerator compartment 30.

A separate storage room 102 may be defined within the refrigerator compartment 30. In detail, the storage room 102 is defined at an edge portion of a lower left side of the refrigerator compartment 30 corresponding to the second door 440 and may be separated from the refrigerator compartment 30 by an insulation wall. The storage room 102 may be maintained at a temperature equal to that of the refrigerator compartment 30. If necessary, the storage room 102 may be maintained at a temperature equal to that of the freezer compartment 30.

The storage room 102 may be covered by the second door 440, and the second door 440 may be slidingly withdrawable. A receiving part 442 having a pantry structure is disposed on a back surface of the second door 440. Thus, the second door 440 may be withdrawn to receive foods into the receiving part 442.

The first door 430 is disposed above the second door 440. A dispenser 436 for dispensing water or ice is disposed in a front surface of the first door 430. An ice making compartment 460 for making and storing the ice is disposed on a back surface of the first door 430 to communicate with the dispenser 436.

A drinking water dispensing hole, an ice dispensing hole, manipulation units of manipulating the dispensing holes, and a residual water tray are further disposed in the dispenser 436, and a display is disposed above the dispenser 436.

Since the ice making compartment 460 may be disposed inside the refrigerator compartment 30 to form a separate independent space insulated from the refrigerator compartment 30. An ice maker 452 for making the ice and an ice bank 454 for storing and transferring the made ice are disposed inside the ice making compartment 460.

The ice making compartment 460 is disposed in an upper portion of the first door 430, and the receiving part 434 is disposed below the ice making compartment 460. The receiving part 434 is exposed to the inside of the refrigerator compartment 30. The receiving part 434 is disposed at a position that is viewable through the refrigerator compartment door 32 to enable the foods received into the receiving part 434 to be viewed through the refrigerator compartment door 32.

The first door 430 is disposed inside the body 10, and thus, is slidingly withdrawn by a rail member 60. At this time, since the first door 430 is adjacent to an inner upper surface and a left sidewall of the refrigerator compartment 30, the rail member 60 and a rail mounting member 70 on which the rail member 60 is mounted are disposed on the inner top surface and the left sidewall of the refrigerator compartment 30. Thus, the first door 430 may be slidingly withdrawn in a state where the first door 430 is supported by the inner top surface and the left sidewall of the refrigerator compartment 30.

The rail member 60 is disposed also on the second door 440 to slidingly withdraw the second door 440. At this time, the rail member 60 may be disposed at any position of inner top and bottom surfaces and left and right side surfaces of the storage room 102. Also, the rail member 60 may be disposed on only a left side surface and a bottom surface of the storage room 102, as the previously described embodiment.

When the first door 430 and the second door 440 are inserted, a lower end of the first door 430 and an upper end of the second door 440 are in contact with an upper end of the storage room 102. Thus, when the first door 430 and the second door 440 are closed, it may prevent the cool air from leaking between the first door 430 and the second door 440.

Figure 42:
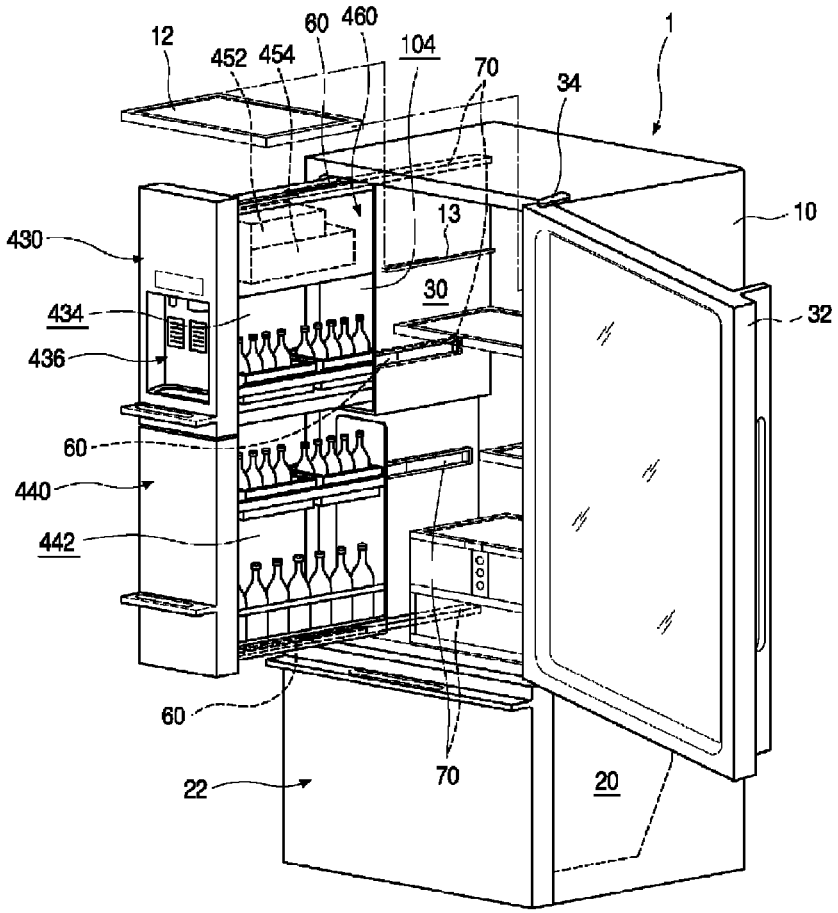
FIG. 42 is a perspective view of a refrigerator when a door is opened, according to further another embodiment.

FIG. 42 is a perspective view of a refrigerator when a door is opened, according to further another embodiment.

Referring to FIG. 42, a refrigerator of the present embodiment has the same structure as that of FIG. 41, except that a separate storage room is defined at a side of the refrigerator compartment. Thus, duplicated descriptions with respect to other configurations except for a configuration of an inner space of the refrigerator compartment will be omitted.

In detail, a body 10 of the present embodiment is vertically partitioned into a refrigerator compartment 30 and a freezer compartment 20. The refrigerator compartment 30 is selectively covered by a refrigerator compartment door 32 and a second door 440. The freezer compartment 20 is selectively covered by a freezer compartment door 22. At this time, an opened front surface of the body 10 corresponding to a refrigerator compartment region is selectively covered by the refrigerator compartment door 32, the first door 430, and the second door 430.

The refrigerator door 32 is coupled to the body 10 using a hinge 34 to cover a portion of an opened front surface of the refrigerator compartment 30 by a rotation thereof. Also, the second door 440 including a receiving part 442 may be withdrawn forwardly and backwardly in a drawer-type to cover the remaining portion of the refrigerator compartment 30.

A separate storage room 104 may be defined within the refrigerator compartment 30. The storage room 104 is defined at an edge portion of an upper left side of the refrigerator compartment 30 corresponding to the first door 430 and may be separated from the refrigerator compartment 30 by an insulation wall. The storage room 104 may be maintained at a temperature equal to that of the freezer compartment 20. If necessary, the storage room 104 may be maintained at a temperature equal to that of the refrigerator compartment 20.

The storage room 104 may be covered by the first door 430, and the first door 430 may be slidingly withdrawable. A dispenser 436 for dispensing water and ice is disposed in a front surface of the first door 430. An ice making compartment 460 for making and storing the ice is disposed on a back surface of the first door 430 to communicate with the dispenser 436.

Dispensing holes for dispensing drinking water and ice, manipulation units of manipulating the dispensing holes, and a residual water tray are further disposed in the dispenser 436, and a display is disposed above the dispenser 436.

The ice making compartment 460 is disposed in an upper portion of the first door 430, and the receiving part 434 is disposed below the ice making compartment 460. The ice making compartment 460 and the receiving part 434 are disposed inside the storage room 104 when the first door 430 is inserted. Also, the ice making compartment 460 and the receiving part 434 may be selectively withdrawn from the storage room 104 according to an opening/closing operation of the first door 430.

For this, a rail mounting member 70 is disposed on a top surface and left and right side surfaces of the refrigerator compartment adjacent to the first door 430. A rail member 60 for supporting left and right side surfaces and a top surface of the first door 430 is mounted on the rail mounting member 70. The rail mounting member 70 and the rail member 60 may be disposed on both sidewalls of the inside of the storage room 104.

When the storage room 104 is maintained at a temperature below zero corresponding to that of the freezer compartment 20, a separate insulation space may be not defined in the ice making compartment 460. In detail, the ice making compartment 460 may provide only a space in which the ice maker 452 and the ice bank 454 are disposed and may be exposed to cool air within the storage room 104 to make ice. The receiving part 434 disposed on the back surface of the first door 430 may receives foods to be frozen.

A shelf 12 disposed inside the refrigerator compartment 30 may have a width corresponding to a distance between a right sidewall of the refrigerator compartment 30 and a right sidewall of the storage room 104. In this case, the shelf 12 may be detachably disposed on seating parts 13 protruding from an inner sidewall of the refrigerator compartment 30 and an outer sidewall of the storage room 104.

The second door 440 is disposed below the first door 430. The second door 440 may be slidingly withdrawable into the refrigerator compartment 30 by a rail member 60.

In detail, since the second door 440 is adjacent to an inner bottom surface and a left sidewall of the refrigerator compartment 30, the rail member 60 and a rail mounting member 70 are disposed on the inner bottom surface and the left sidewall of the refrigerator compartment 30. Thus, the second door 440 may be slidingly withdrawn in a state where the second door 440 is supported by the inner bottom surface and the left sidewall of the refrigerator compartment 30.

When the second door 440 is closed, the receiving part 442 of the second door 440 is disposed inside the refrigerator compartment 30. Thus, foods stored in the receiving part 442 of the second door 440 may be viewed through the transparent refrigerator compartment door 32 without opening the refrigerator compartment door 32 and the second door 440.

When the first door 430 and the second door 440 are inserted, a lower end of the first door 430 and an upper end of the second door 440 are in contact with an upper end of a front surface of the storage room 102. Thus, when the first door 430 and the second door 440 are completely inserted, it may prevent the cool air from leaking between the first door 430 and the second door 440.

Figure 43:
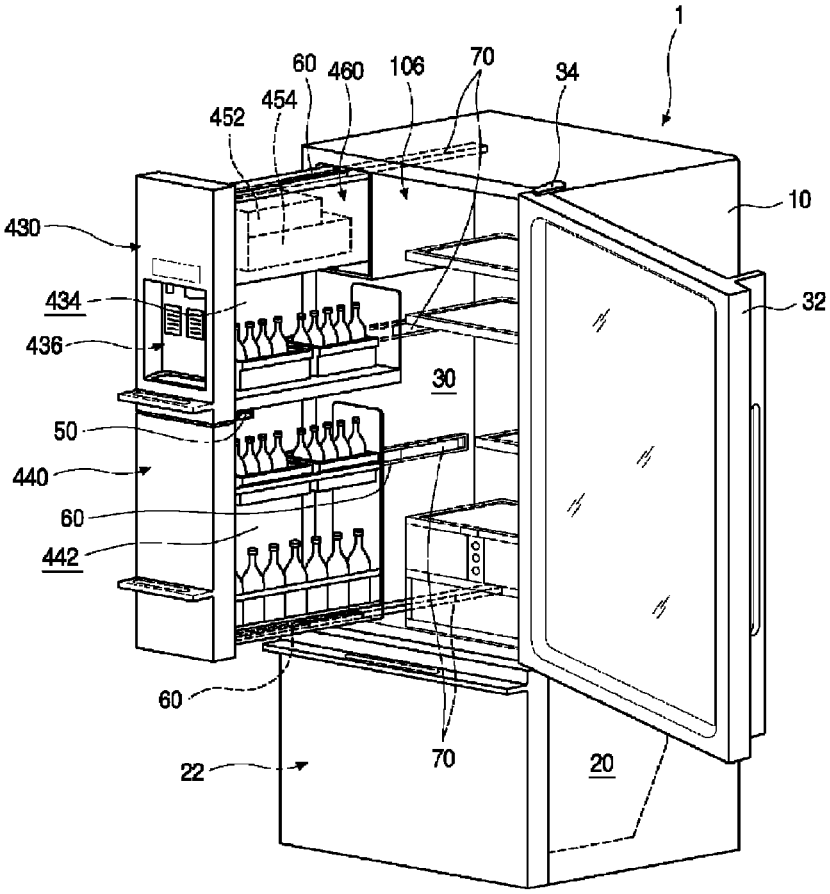
FIG. 43 is a perspective view of a refrigerator when a door is opened, according to further another embodiment.

FIG. 43 is a perspective view of a refrigerator when a door is opened, according to further another embodiment.

Referring to FIG. 43, a refrigerator of the present embodiment has the same structure as that of FIG. 40, except that a separate storage room is defined inside the refrigerator compartment. Thus, duplicated descriptions with respect to other configurations except for a configuration of an inner space of the refrigerator compartment will be omitted.

In detail, a body 10 of the present embodiment is vertically partitioned into a refrigerator compartment 30 and a freezer compartment 20. The refrigerator compartment 30 is selectively covered by a refrigerator compartment door 32, a first door 430, and a second door 440. The freezer compartment 20 is selectively covered by a freezer compartment door 22.

The refrigerator door 32 is coupled to the body 10 using a hinge 34 to cover a portion of an opened front surface of the refrigerator compartment 30 by a rotation thereof. Also, the first door 430 and the second door 440 including receiving parts 434 and 442 may be withdrawn forwardly and backwardly in a drawer-type to cover the remaining portion of the refrigerator compartment 30.

A separate storage room 106 may be defined within the refrigerator compartment 30. In detail, the storage room 106 may be defined at a position corresponding to an ice making compartment 460 disposed on a back surface of the first door 430. Also, the storage room 106 may have a size corresponding to that in which the ice making compartment 460 is withdrawable.

The storage room 106 is defined at an edge portion of an upper left side of the refrigerator compartment 30 corresponding to the ice making compartment 460.

The storage room 106 may be maintained at a temperature below zero at which ice can be made and may be separated from the refrigerator compartment 30 by an insulation wall.

The storage room 106 may be covered by a portion of the first door 430 corresponding to that of the ice making compartment 460 disposed on the first door 430, and a portion of the refrigerator compartment 30 may be covered by the remaining portion of the first door 430.

A dispenser 436 for dispensing water and ice is disposed in a front surface of the first door 430. An ice making compartment 460 for making and storing the ice is disposed on a back surface of the first door 430 to communicate with the dispenser 436.

Dispensing holes for dispensing drinking water and ice, manipulation units of manipulating the dispensing holes, and a residual water tray are further disposed in the dispenser 436, and a display is disposed above the dispenser 436.

When the storage room 106 is maintained at a temperature below zero corresponding to that of the freezer compartment 20, a separate insulation space may be not defined in the ice making compartment 460. In detail, the ice making compartment 460 may provide only a space in which the ice maker 452 and the ice bank 454 are disposed and may be exposed to cool air within the storage room 104 to make ice.

The ice making compartment 460 is disposed in an upper portion of the first door 430, and the receiving part 434 is disposed below the ice making compartment 460. When the first door 430 is closed, the ice making compartment 460 is disposed inside the storage room 106, and the receiving part 434 is disposed inside the refrigerator compartment 30 below the storage room 106.

A rail member 60 is disposed on top and left side surfaces of the storage room 106 corresponding to top and left side surfaces of the first door 430. The first door 430 may be withdrawable forwardly and backwardly by the rail member 60. The rail member 60 disposed on the left side surface of the first door 430 may be provided in plurality. In this case, the rail members 60 may be disposed on left side surfaces of the ice making compartment 460 and the receiving part 434, respectively.

A front surface of the storage room 106 and a portion of the refrigerator compartment 30 may be selectively covered according to the withdrawal of the first door 430. When the first door 430 is withdrawn, the ice making compartment 460 and the receiving part 434 may be exposed to the outside. When the first door 430 is inserted, the receiving part 434 of the first door 430 is disposed inside the refrigerator compartment 30 and may be viewed through the refrigerator compartment door 32 from the outside.

The second door 440 is disposed below the first door 430. The second door 440 may be slidingly withdrawable into the refrigerator compartment 30 by a rail member 60.

In detail, since the second door 440 is adjacent to an inner bottom surface and a left sidewall of the refrigerator compartment 30, the rail member 60 and a rail mounting member 70 on which the rail member 60 is mounted are disposed on the inner bottom surface and the left sidewall of the refrigerator compartment 30. Thus, the second door 440 may be slidingly withdrawn in a state where the second door 440 is supported by the inner bottom surface and the left sidewall of the refrigerator compartment 30.

When the second door 440 is closed, the receiving part 442 of the second door 440 is disposed inside the refrigerator compartment 30. Thus, foods stored in the receiving part 442 of the second door 440 may be viewed through the transparent refrigerator compartment door 32 without opening the refrigerator compartment door 32 and the second door 440.

A pillar 50 is disposed at a lower end of the first door 430 to prevent cool air from leaking between the first door 430 and the second door 440 when the first door 430 and the second door 440 are closed.

Figure 44:
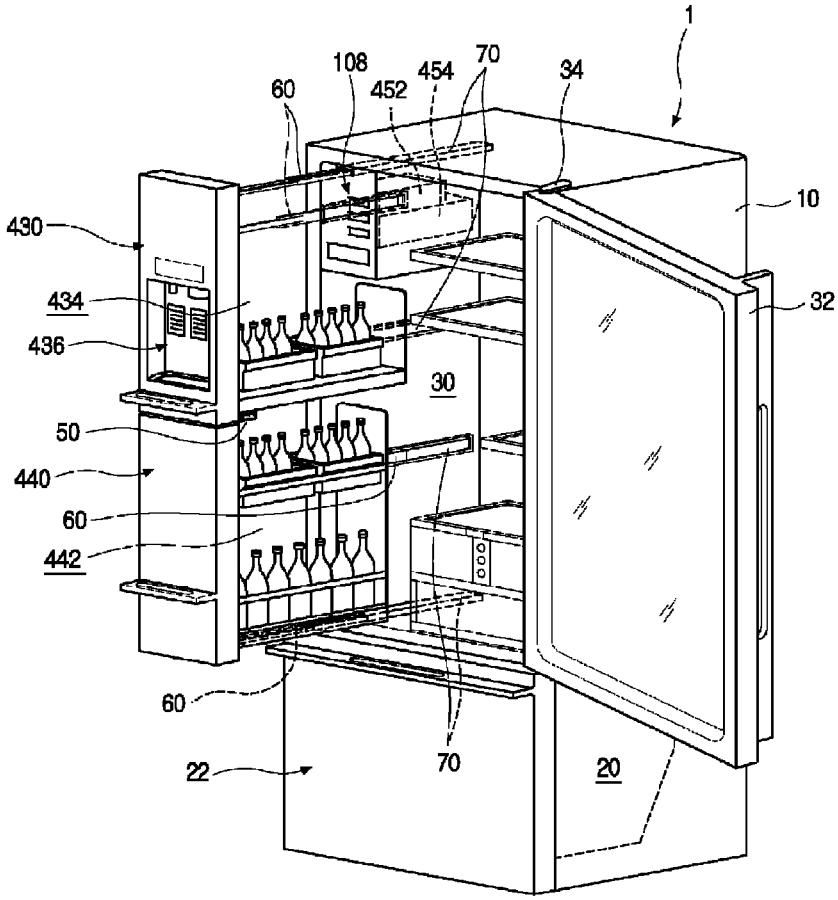
FIG. 44 is a perspective view of a refrigerator when a door is opened, according to further another embodiment.

FIG. 44 is a perspective view of a refrigerator when a door is opened, according to further another embodiment.

Referring to FIG. 44, a refrigerator of the present embodiment has the same structure as that of FIG. 37, except that a separate storage room is defined inside the refrigerator compartment. Thus, duplicated descriptions with respect to other configurations except for a configuration of an inner space of the refrigerator compartment will be omitted.

In detail, a body 10 of the present embodiment is vertically partitioned into a refrigerator compartment 30 and a freezer compartment 20. The refrigerator compartment 30 is selectively covered by a refrigerator compartment door 32, a first door 430, and a second door 440. The freezer compartment 20 is selectively covered by a freezer compartment door 22.

The refrigerator door 32 is coupled to the body 10 using a hinge 34 to cover a portion of an opened front surface of the refrigerator compartment 30 by a rotation thereof. Also, the first door 430 and the second door 440 including receiving parts 434 and 442 may be withdrawn forwardly and backwardly in a drawer-type to cover the remaining portion of the refrigerator compartment 30.

A storage room 108, which is defined as a separate insulation space, may be defined within the refrigerator compartment 30. In detail, the storage room 108 may be disposed at a rear side of the first door 430, and when the first door 830 is closed, a front surface of the storage room 108 may be covered. An ice maker 452 and an ice bank 454 are disposed inside the storage room 108, and a front surface of the storage room 108 may be opened and closed by a cover.

The storage room 108 is defined at an edge portion of an upper left side of the refrigerator compartment 30. Also, the storage room 108 may be separated from the refrigerator compartment 30 by an insulation wall, and thus, may be maintained at a temperature below zero at which ice can be made.

A dispenser 436 for dispensing water and ice is disposed in a front surface of the first door 430. An ice making compartment 460 for making and storing the ice is disposed on a back surface of the first door 430 to communicate with the dispenser 436.

A drinking water dispensing hole, an ice dispensing hole, manipulation units of manipulating the dispensing holes, and a residual water tray are further disposed in the dispenser 436, and a display is disposed above the dispenser 436.

A rail member 60 is disposed on top and left side surfaces of the storage room 108 corresponding to top and left side surfaces of the first door 430. The first door 430 may be withdrawable forwardly and backwardly by the rail member 60. The rail member 60 disposed on the left side surface of the first door 430 may be provided in plurality. In this case, the rail members 60 may be disposed on left side surfaces of the ice making compartment 460 and the receiving part 434, respectively.

A front surface of the storage room 108 and a portion of the refrigerator compartment 30 may be selectively covered according to the withdrawal of the first door 430. When the first door 430 is withdrawn, the ice making compartment 460 and the receiving part 434 may be exposed to the outside.

When the first door 430 is inserted, the receiving part 434 of the first door 430 is disposed inside the refrigerator compartment 30 and may be viewed through the refrigerator compartment door 32 from the outside.

The second door 440 is disposed below the first door 430. The second door 440 may be slidingly withdrawable into the refrigerator compartment 30 by a rail member 60.

In detail, since the second door 440 is adjacent to an inner bottom surface and a left sidewall of the refrigerator compartment 30, the rail member 60 and a rail mounting member 70 on which the rail member 60 is mounted are disposed on the inner bottom surface and the left sidewall of the refrigerator compartment 30. Thus, the second door 440 may be slidingly withdrawn in a state where the second door 440 is supported by the inner bottom surface and the left sidewall of the refrigerator compartment 30.

When the second door 440 is closed, the receiving part 442 of the second door 440 is disposed inside the refrigerator compartment 30. Thus, foods stored in the receiving part 442 of the second door 440 may be viewed through the transparent refrigerator compartment door 32 without opening the refrigerator compartment door 32 and the second door 440.

A pillar 50 is disposed at a lower end of the first door 430 to prevent cool air from leaking between the first door 430 and the second door 440 when the first door 430 and the second door 440 are closed.

Figure 45:
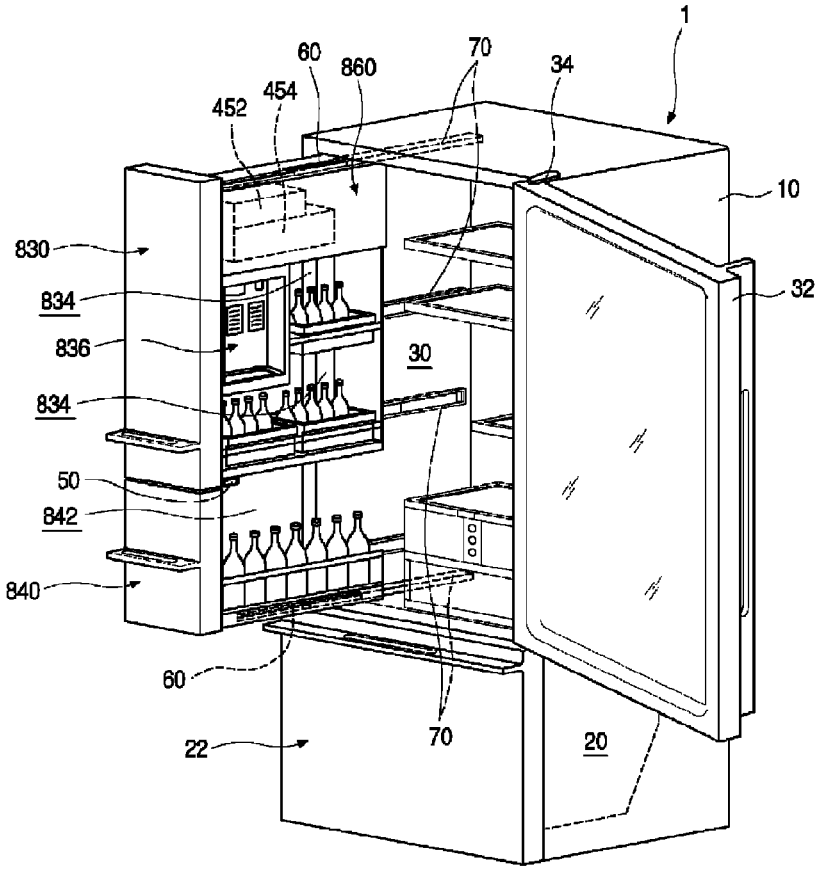
FIG. 45 is a perspective view of a refrigerator when a door is opened, according to further another embodiment.

FIG. 45 is a perspective view of a refrigerator when a door is opened, according to further another embodiment.

Referring to FIG. 45, a refrigerator of the present embodiment has the same structure as that of FIG. 37, except for configurations of a first door and a second door and a position of a dispenser. Thus, duplicated descriptions with respect to the configurations of the first and second doors and the position of the dispenser will be omitted.

In detail, a body 10 of the present embodiment is vertically partitioned into a refrigerator compartment 30 and a freezer compartment 20. The refrigerator compartment 30 is selectively covered by a refrigerator compartment door 32, a first door 830, and a second door 840. The freezer compartment 20 is selectively covered by a freezer compartment door 22.

The refrigerator door 32 is coupled to the body 10 using a hinge 34 to cover a portion of an opened front surface of the refrigerator compartment 30 by a rotation thereof. Also, the first door 830 and the second door 840 including receiving parts 834 and 842 may be withdrawn forwardly and backwardly in a drawer-type to cover the remaining portion of the refrigerator compartment 30.

The first door 830 and the second door 840 are disposed at a left side of the refrigerator compartment door 32, and the first door 830 may be disposed above the second door 840. A rail member 60 for slidingly guiding the withdrawal of the first door 830 is disposed on top and left side surfaces of the refrigerator compartment 30 corresponding to the first door 830. The rail member 60 is fixed inside the refrigerator compartment 30 by a rail mounting member 70.

The first door 830 may have a vertical length somewhat loner than that of the second door 840. An ice making compartment 860 is disposed on an upper portion of a back surface of the first door 830. The ice making compartment 860 provides a space for making and storing ice. The ice making compartment 860 receives an ice maker 452 and an ice bank 454.

Since the ice making compartment 860 should be maintained at a temperature below zero to make the ice, the ice making compartment 860 may be insulated from the refrigerator compartment 30. A dispenser 836 for dispensing water or ice is disposed at a rear side of the first door 830.

In detail, the dispenser 836 is disposed at a lower portion of the ice making compartment 860. For use s convenience, the dispenser 836 may be disposed at a middle portion or a lower portion of the first door 830 to allow a user to access the dispenser 836. The dispenser 836 communicates with the ice making compartment 860, and thus, may receive the made ice from the ice making compartment 860.

The dispenser 836 is disposed facing the refrigerator compartment 30 to enable the dispenser 836 and the receiving part 834 to be viewed through the refrigerator compartment door 32 even through the first door 830 is closed. Also, the dispenser 836 may be exposed laterally outside the refrigerator compartment 30 when the first door 830 is slidingly withdrawn.

A drinking water dispensing hole, an ice dispensing hole, manipulation units of manipulating the dispensing holes, and a residual water tray are further disposed in the dispenser 836, and a display is disposed above the dispenser 836.

A receiving part 834 having multi-stages is disposed at rear and lower sides of the dispenser 836 to receive foods.

The second door 840 is disposed below the first door 830. The second door 840 may be slidingly withdrawable into the refrigerator compartment 30 by a rail member 60.

In detail, since the second door 840 is adjacent to an inner bottom surface and a left sidewall of the refrigerator compartment 30, the rail member 60 and a rail mounting member 70 on which the rail member 60 is mounted are disposed on the inner bottom surface and the left sidewall of the refrigerator compartment 30. Thus, the second door 840 may be slidingly withdrawn in a state where the second door 440 is supported by the inner bottom surface and the left sidewall of the refrigerator compartment 30.

When the first door 830 and the second door 840 are closed, the receiving part 834 having the multi-states and the receiving part 842 disposed on the second door 840 are disposed on the first door 830. Thus, foods stored in the receiving part 834 and 842 of the first door 830 and the second door 840 may be viewed through the transparent refrigerator compartment door 32 even through the refrigerator compartment door 32 is closed.

When the refrigerator compartment door 32 is rotated to open the refrigerator compartment 30, the dispenser 836 is exposed to the inside of the refrigerator compartment 30. Thus, the user may use the dispenser 836 without opening the first door 830.

Vertical lengths of the first door 830 and the second door 840 may be varied as necessary. Thus, the receiving parts 834 and 842 disposed on the first door 830 and the second door 840 may be variously arranged according to the vertical lengths of the first door 830 and the second door 840.

A pillar 50 is disposed at a lower end of the first door 830 to prevent cool air from leaking between the first door 830 and the second door 840 when the first door 830 and the second door 840 are closed.

Figure 46:
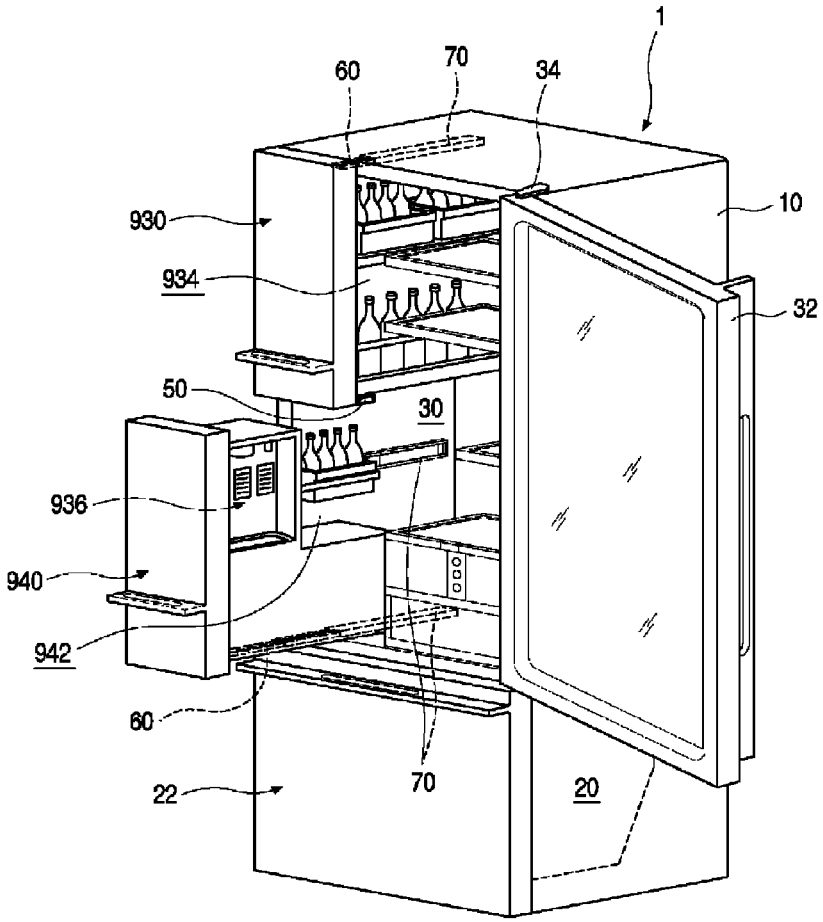
FIG. 46 is a perspective view of a refrigerator when a door is opened, according to further another embodiment.

FIG. 46 is a perspective view of a refrigerator when a door is opened, according to further another embodiment.

Referring to FIG. 46, a refrigerator of the present embodiment has the same structure as that of FIG. 37, except for configurations of a first door and a second door and a position of a dispenser. Thus, duplicated descriptions with respect to the configurations of the first and second doors and the position of the dispenser will be omitted.

In detail, a body 10 of the present embodiment is vertically partitioned into a refrigerator compartment 30 and a freezer compartment 20. The refrigerator compartment 30 is selectively covered by a refrigerator compartment door 32, a first door 930, and a second door 940. The freezer compartment 20 is selectively covered by a freezer compartment door 22.

The refrigerator door 32 covers a portion of an opened front surface of the refrigerator compartment 30 by a rotation thereof. Also, the first door 930 and the second door 940 including receiving parts 934 and 942 may be withdrawn forwardly and backwardly in a drawer-type to cover the remaining portion of the refrigerator compartment 30.

The first door 930 and the second door 940 are disposed at a left side of the refrigerator compartment door 32, and the first door 930 may be disposed above the second door 940. A rail member 60 for slidingly guiding the withdrawal of the first door 930 is disposed on top and left side surfaces of the refrigerator compartment 30 corresponding to the first door 930. The rail member 60 is fixed inside the refrigerator compartment 30 by a rail mounting member 70.

A receiving part 934 for receiving foods is disposed at a rear side of the first door 930. The receiving part 934 may have one stage or two stages and may have various structures to receive a variety of foods.

The second door 940 is disposed below the first door 930. The second door 940 may be slidingly withdrawable into the refrigerator compartment 30 by a rail member 60.

In detail, since the second door 940 is adjacent to an inner bottom surface and a left sidewall of the refrigerator compartment 30, the rail member 60 and a rail mounting member 70 on which the rail member 60 is mounted are disposed on the inner bottom surface and the left sidewall of the refrigerator compartment 30. Thus, the second door 940 may be slidingly withdrawn in a state where the second door 940 is supported by the inner bottom surface and the left sidewall of the refrigerator compartment 30.

An ice making compartment 960 is disposed on an upper portion of a back surface of the first door 930. The ice making compartment 960 provides a space for making and storing ice. The ice making compartment 960 receives an ice maker 452 and an ice bank 454.

Since the ice making compartment 960 should be maintained at a temperature below zero to make the ice, the ice making compartment 960 may be insulated from the refrigerator compartment 30. A dispenser 936 for dispensing water or ice is disposed on the back surface of the second door 940 communicating with the ice making compartment 960.

The dispenser 936 is disposed at a lower portion of the ice making compartment 960. The ice within the ice making compartment 960 may be moved toward the dispenser 936 by a transfer device.

A drinking water dispensing hole, an ice dispensing hole, manipulation units of manipulating the dispensing holes, and a residual water tray are further disposed in the dispenser 936, and a display is disposed above the dispenser 936.

The receiving parts 934 and 942 disposed on the first door 930 and the second door 940 are disposed inside the refrigerator compartment 30 when the first door 930 and the second door 940 are closed. Thus, foods stored in the receiving part 934 and 942 of the first door 930 and the second door 940 may be viewed through the transparent refrigerator compartment door 32 even through the refrigerator compartment door 32 is closed.

When the refrigerator compartment door 32 is opened, the dispenser 936 is exposed to the inside of the refrigerator compartment 30. Thus, the user may use the dispenser 936 without opening the second door 940.

A pillar 50 is disposed at a lower end of the first door 930 to prevent cool air from leaking between the first door 930 and the second door 940 when the first door 930 and the second door 940 are closed.

The invention claimed is:

1. A refrigerator comprising:
- a refrigerator compartment;
- a freezer compartment;
- a plurality of refrigerator compartment doors opening and closing the refrigerator compartment, the refrigerator compartment doors comprising a pivotable door and a slidable door;
- a freezer compartment door opening and closing the freezer compartment;
- a dispenser disposed on the slidable door to dispense water and/or ice;
- an ice making compartment fixed to a back surface of the slidable door; and
- one or more water supply passages extending toward one or all of the dispenser and the ice making compartment,
- wherein the one or more water supply passages are divided at predetermined positions, respectively, and are selectively coupled at the divided positions according to forward and backward movement of the slidable door.

2. The refrigerator according to claim 1, wherein the dispenser comprises one or all of a water dispensing hole and an ice chute for dispensing the ice.

3. The refrigerator according to claim 1, wherein the one or more water supply passages are directly connected to a water supply source.

4. The refrigerator according to claim 1, further comprising a water tank disposed at a side of the inside of the refrigerator compartment, wherein the one or more water supply passages are connected to the water tank.

5. The refrigerator according to claim 1, wherein opening/closing valves are disposed at the divided positions, respectively.

6. The refrigerator according to claim 1, further comprising an ice making assembly received into the ice making compartment, wherein the ice making assembly comprises:
- an ice maker making the ice;
- an ice bank storing the ice made from the ice maker; and
- a transfer unit disposed inside the ice bank, the transfer unit transferring the ice.

7. The refrigerator according to claim 1, wherein the ice making compartment has a front-and-rear length longer than a left-and-right length thereof.

8. The refrigerator according to claim 1, further comprising a receiving part disposed on the back surface of the slidable door, wherein the receiving part is disposed below the ice making compartment.

9. The refrigerator according to claim 1, further comprising:
- at least one rail member extending in a rear direction of the slidable door, and the rail member guiding forward and backward movement of the slidable door;
- a display disposed on a front surface of the slidable door; and
- a wire extending in a state it is received in the rail member, the wire being electrically connected to the display.

10. The refrigerator according to claim 1, further comprising:
- a display disposed on a front surface of the slidable door
- a socket disposed on one side of a front surface of a body defining the refrigerator compartment and a back surface of the slidable door;

a plug disposed on the other side of the front surface of the body defining the refrigerator compartment and the back surface of the slidable door; and a battery laid inside the slidable door, the battery being electrically connected to the plug thereby being charged and discharged, wherein the battery supplies a power source to the display disposed on at least the slidable door.

11. A refrigerator comprising:

a refrigerator compartment;

a freezer compartment;

a plurality of refrigerator compartment doors opening and closing the refrigerator compartment, the refrigerator compartment doors comprising a pivotable door and a slidable door;

a freezer compartment door opening and closing the freezer compartment;

a dispenser disposed on the slidable door and configured to dispense water and ice;

an ice making compartment provided to make ice and supply the ice to the dispenser, the ice making compartment configured to be received in the refrigerator compartment when the slidable door is in a closed position, and at least a part of the ice making compartment being fixed to a rear surface of the slidable door;

a first water supply passage for ice making which extends toward the ice making compartment; and a second water supply passage for supplying water which extends towards the dispenser, wherein, when the slidable door is drawn out forward, at least one of the first water supply passage or the second water supply passage is disconnected at a predetermined position and is connected at the predetermined position when the slidable door is drawn in backward.

12. The refrigerator of claim 11, wherein, when the slidable door is drawn out forward, the first water supply passage and the second water supply passage are disconnected at the predetermined position and are connected at the predetermined position when the slidable door is drawn in backward.

13. The refrigerator of claim 11, wherein, when the slidable door is drawn out forward, the first water supply passage is disconnected at the predetermined position and is connected at the predetermined position when the slidable door is drawn in backward.

14. The refrigerator of claim 11, wherein, when the slidable door is drawn out forward, the second water supply passage is disconnected at the predetermined position and is connected at the predetermined position when the slidable door is drawn in backward.

15. A refrigerator comprising:

a refrigerator compartment;

a storage room defined next to the refrigerator compartment;

a freezer compartment below the refrigerator compartment and the storage room;

a refrigerator compartment door configured to open and close at least a portion of the refrigerator compartment;

a slidable door configured to open and close the storage room;

a freezer compartment door configured to open and close the freezer compartment;

an ice making compartment received in the storage room, the ice making compartment including:

an ice making compartment upper part disposed in an inside of the storage room, and in which an ice maker is received, and an ice making compartment lower part fixed to a rear surface of the slidable door to integrally move with the slidable door, and in which an ice bank is received;

an ice making water supply passage extending towards the ice maker; and a dispenser disposed on the slidable door to dispense water and ice, the dispenser including:

a drinking water supply passage extending towards the dispenser, and an ice chute configured to discharge ice stored in the ice bank.

* * * * *